US006351977B1

(12) United States Patent
Pedroso et al.

(10) Patent No.: US 6,351,977 B1
(45) Date of Patent: Mar. 5, 2002

(54) SECURITY DOOR LOCK WITH REMOTE CONTROL

(76) Inventors: Paul L. Pedroso, 17 Fourth Ave., Lowell, MA (US) 01854; Duarte M. Oliveria, 23 Valley Rd., Lunenberg, MA (US) 01462

( * ) Notice: Subject to any disclaimer, the term of this patent is extended or adjusted under 35 U.S.C. 154(b) by 0 days.

(21) Appl. No.: 09/596,598

(22) Filed: Jun. 19, 2000

Related U.S. Application Data

(63) Continuation-in-part of application No. 09/129,648, filed on Aug. 5, 1998, now Pat. No. 6,076,385.

(51) Int. Cl.[7] ..... E05B 47/02

(52) U.S. Cl. ..... 70/257; 70/277; 70/278.6; 70/280; 292/144; 292/162; 292/DIG. 51

(58) Field of Search ..... 70/256, 257, 277, 70/278.6, 278.7, 280, 281, 282; 292/144, 162, DIG. 51

(56) References Cited

U.S. PATENT DOCUMENTS

| | | | | | |
|---|---|---|---|---|---|
| 608,321 | A | | 8/1898 | Carleton | |
| 3,820,284 | A | | 6/1974 | Boughton | 49/449 |
| 4,212,489 | A | * | 7/1980 | Synder | 292/33 |
| 4,218,681 | A | | 8/1980 | Hörmann | 455/603 |
| 4,355,399 | A | | 10/1982 | Timor | 375/1 |
| 4,573,046 | A | | 2/1986 | Pinnow | 340/825.56 |
| 4,683,733 | A | | 8/1987 | Marin | 70/134 |
| 4,770,012 | A | | 9/1988 | Johansson et al. | 70/278 |
| 4,794,268 | A | | 12/1988 | Nakano et al. | 307/10 AT |
| 4,802,353 | A | | 2/1989 | Corder et al. | 70/277 |
| 4,820,330 | A | | 4/1989 | Lin | 70/277 |
| 4,877,275 | A | | 10/1989 | DeForrest, Sr. | 292/148 |
| 4,970,494 | A | | 11/1990 | Keely et al. | 340/567 |
| 5,261,260 | A | | 11/1993 | Lin | 70/280 |
| 5,525,973 | A | | 06/1996 | Lindreou et al. | 340/825.31 |
| 5,646,605 | A | | 7/1997 | Leonaggeo et al. | 340/825.31 |
| 5,650,774 | A | * | 7/1997 | Drori | 340/825.32 |
| 5,712,626 | A | | 1/1998 | Andreou et al. | 340/825.31 |

* cited by examiner

*Primary Examiner*—William A. Cuchlinski, Jr.
*Assistant Examiner*—Marthe Marc-Coleman
(74) *Attorney, Agent, or Firm*—Pearson & Pearson, LLP

(57) ABSTRACT

An electrically operated, strong, security system comprising a lock with remote control installed in a wall adjacent to a door frame or under a door. The lock comprises at least one rod which extends into the door when the door is closed and in a locked state. In an unlocked state an actuator retracts the rods from the door, back into the door frame or into the floor. The security lock system provides a manual control for the lock inside a house or building along with indicator lights showing the lock status. An emergency DC battery provides power for the security lock if there is a primary power outage. A remote control locks all doors in the house simultaneous that have such a security lock, and the remote control unlocks only the door or doors selected to be unlocked. The underfloor embodiment of the lock comprises mounting an elongated moveable rod within the door whereby the rod extending from the underfloor lock pushes the door rod upward into the top of the door frame thereby securing the door at the top and the bottom.

34 Claims, 19 Drawing Sheets

SECURITY DOOR LOCK WITH REMOTE CONTROL

CROSS REFERENCE TO RELATED APPLICATION

This is a continuation-in-part of application Ser. No. 09/129,648 filed Aug. 5, 1998 now U.S. Pat. No. 6,076,385 and assigned to the same assignee as this application.

BACKGROUND OF THE INVENTION

1. Field of the Invention

This invention relates to an electrically powered door lock system and in particular to a remote controlled security door lock for installation in a wall adjacent to a door or under a door and capable of remote control operation.

2. Description of Related Art

Keyless door locks in a house or building provide a user with considerable convenience especially when the users hands are full carrying items.

U.S. Pat. No. 4,802,353 issued Feb. 7, 1989 to Corder et al discloses a battery-powered electromechanical door-lock assembly which is keyless. A bolt assembly includes electromagnetic means responsive to an input signal for energization and positioned to hold the locking assembly in the unlocked position upon energization thereof to prevent moving of the locking assembly to the locked position upon movement of the handle. The locking assembly comprises a control housing on the interior of the door including digital circuitry for the lock powered by batteries.

U.S. Pat. No. 5,525,973 issued Jun. 11, 1996 to Andreou et al discloses a remotely-operated self contained electronic lock security system. A remote hand held controller transmits coded signals to an electronic door lock. The lock is sized and configured to be utilized with a conventional doorlatch lock mechanism. For example, the mechanical "locking" portion of the apparatus and optical or radio frequency sensor is preferably constructed so as to be installable within the exterior handle of a conventional door handle; the interior handle is equipped with a battery and an electronic control device. Most of the components of conventional doorlatch locks are used.

U.S. Pat. No. 4,820,330 issued Apr. 11, 1989 to Jui-Chang Lin discloses a structure for controlling the dead bolts used in an electric lock. The lock requires the use of a special card which has an invisible coded number on it, but allows the lock to function as a common lock with the electronic part temporarily stopped.

None of the disclosed locks in the prior art have the combined features of being extra strong, remote controlled, security locks, which are not easily overcome or broken by an intruder.

SUMMARY OF THE INVENTION

Accordingly, it is therefore an object of this invention to provide a strong security door lock for a house or building which is operated by remote control.

It is object of this invention to provide a strong security door lock which is installed in a wall adjacent to a door.

It is a further object of this invention to provide an underfloor doorlock in combination with an elongated rod mounted in a door whereby a first rod extending from under the door pushes the elongated rod within the door upward into the door frame above the door thereby securing the door at the top and the bottom.

It is another object of this invention to provide for manual operation of the remote control security door lock.

It is yet another object of this invention to provide a sensor for determining that a door is closed prior to activating the remote controlled security door lock.

It is another object of this invention to provide a remote controlled security door lock system having a locking mechanism installed in a wall adjacent to a door.

It is further object of this invention to provide an emergency DC power source for operating the security system when a power outage occurs.

These and other objects are accomplished by a security door lock for mounting inside a wall comprising means for generating a signal to activate and to deactivate the door lock, means, connected to the signal generating means for extending a piston a predetermined distance in response to the activate signal, means attached to the piston for moving at least one rod the predetermined distance from a first position to a second position when activated, the rod returning to the first position when the lock receives the signal to deactivate, means, attached to the moving means parallel to the piston, for stabilizing the moving means, and the stabilizing means being secured by retaining means attached to a wall of the door lock for allowing the stabilizing means to slide the predetermined distance when the piston is extended. The moving means comprises the one rod protruding from a first area and in parallel with another rod protruding from a second area. The means for extending the piston comprises an actuator. The moving means is attached to the piston with a pair of arms extending from the moving means. The signal generating means comprises means for transmitting a coded signal, means for receiving and decoding the coded signal, means for generating the lock activating signal in response to the decoded signal when the door is closed. The signal generating means comprises a remote control transmitter. The lock comprises means for sensing the door being closed before allowing the piston extending means to be activated. The lock comprises means, extending from the stabilizing means, for manually locking and unlocking the door lock.

The objects are further accomplished by a security door lock system for mounting inside a wall adjacent to a door and a door frame comprising a remote control transmitter for generating a coded signal, receiver means for decoding the coded signal from the transmitter, means for sensing that the door is closed, means connected to the receiver means and the closed door sensing means for generating a lock control signal and an unlock control signal, actuator means connected to the lock control signal generating means for extending a piston a predetermined distance in response to the lock control signal, a rod holder bar attached to the piston for moving at least one rod the predetermined distance from a position in the door frame to a position inside the door in response to the actuator means receiving the lock signal, the at least one rod being retracted to the position in the door frame in response to the actuator means receiving the unlock control signal, a bar stabilizer portion of the rod holder bar, attached approximately perpendicular to a bar portion of the rod holder bar and parallel to the piston, for stabilizing the rod holder bar, the bar stabilizer portion being positioned a predetermined distance away from the attachment of the bar portion to the piston, and the bar stabilizer portion being secured by retaining means attached to a wall of the door lock for allowing the rod holder bar to slide the predetermined distance when the piston is extended. The rod holder bar comprises the one rod protruding from a first end area of the bar portion to within the door frame and another rod protruding from a second end area to within the door frame. The rod holder bar attaches to the piston by a pair of spaced apart arms extending from the bar portion of the rod holder bar. The lock system comprises means extending above the bar stabilizer portion for manually locking and unlocking the door lock system. The system comprises an AC power source and means for providing DC power to the system when the AC power source is unavailable.

The objects are further accomplished by a method of providing a security door lock for use in a wall adjacent to a door and a door frame comprising the steps of generating a signal to activate and a signal to deactivate the door lock, extending a piston attached to an actuator toward a door in response to the activating signal, the piston being positioned in an enclosure adjacent to the door, attaching a rod holder bar approximately perpendicular to an end of the piston, the rod holder bar comprising a bar portion and a bar stabilizer portion perpendicular to the bar portion, extending at least one rod from the bar of the rod holder bar into a door frame, moving the rod from the door frame into the door, when the piston is extended, and stabilizing the rod holder bar means by retaining means attached to a wall of the door lock for allowing the bar stabilizer portion of the rod holder bar to slide in parallel with the extending piston. The step of generating a signal to activate and a signal to deactivate the door lock comprises the steps of generating a coded signal with a remote control transmitter, receiving the coded signal in means for decoding the coded signal, determining the door is closed with sensor means positioned at the door frame prior to providing the activating signal to the piston. The step of extending at least one rod from the rod holder bar comprises the step of extending a second rod from the rod holder bar, the rods being spaced apart a predetermined distance. The method comprises the step of providing a door sensor to determine the door is closed before allowing the piston to be activated. The method comprises the step of manually locking and unlocking the door lock by providing a lever extending from the bar stabilizer portion of the rod holder bar enabling the rod holder bar to be moved back and forth.

The objects are further accomplished by a housing comprising a first generally rectangular area having side walls, a second generally square area having side walls, the second area extending perpendicular to the first generally rectangular area with no barrier between the first area and the second area, a rod holder bar disposed within the first area and the second area, an elongated bar portion positioned in the first area and a bar stabilizer portion attached perpendicular to the bar portion and positioned in the second area, means, attached to an inner wall of the housing, for retaining flanges on lower portions of the bar stabilizer, the retaining means allowing the flanges to slide back and forth, a lever extending above a top portion of the bar stabilizer for manually moving the rod holder bar back and forth within the housing, first threaded receptacles for receiving slide tubes positioned on opposite ends of a front panel of the housing, second threaded receptacles for receiving slider shafts positioned on opposite ends of the bar, and a pair of spaced apart arms extending from the bar parallel to the bar stabilizer. The pair of arms comprises apertures for attaching a piston of an actuator. The rod holder bar comprises wing means for strengthening the intersection of the bar portion and the bar stabilizer portion.

The objects are further accomplished by a security door lock for mounting under a door comprising means for generating a signal to activate and to deactivate the door lock, means, connected to the signal generating means, for extending a piston a first predetermined distance in response to the activate signal, the piston extending means being attached to a housing for the door lock, means attached to the piston for moving a rod a second predetermined distance in a direction opposite the direction of the piston, means, positioned adjacent to the piston extending means and formed as part of the housing, for receiving a hollow tube, the hollow tube being screwed into the part of the housing, and an end of the rod being inserted into the hollow tube and attached to the rod moving means beyond the hollow tube. The rod moving means comprises an interleaving rack and cam combination, the rack being attached to the piston extending means and the cam having a cam follower coupled thereto, the cam follower being attached to the rod. The rod moving means comprises a rack attached to the piston, the rack comprises teeth which interleave with teeth of a sprocket portion of a cam, the cam driving the rod whereby the rack and cam translate the extending of the piston into moving the rod in the opposite direction. The door lock comprises a cam follower having a guide post, and the cam comprises a curved channel for the guide post to travel therein, the cam follower being attached to an end of the rod for moving the rod into the door. The rod moves the predetermined distance into a bottom portion of a door, the rod pushing a second rod upward the second predetermined distance within the door and into a door frame above the door.

The objects are further accomplished by in combination, a housing for a door lock, an actuator mounted in the housing having a piston, the piston extending in response to a control signal, a rack attached to an end of the piston, the rack having a side edge inserted in a linear channel of the housing, the rack having a plurality of teeth, a cam comprises a sprocket, the sprocket comprises a plurality of teeth, the plurality of teeth of the sprocket positioned to mesh with the plurality of teeth of the rack for driving the cam, the cam further includes an open curved channel, a cam follower having a guide post, the guide post being positioned in the curved channel of the cam, the cam follower having a stabilizer portion inserted into a linear follower channel of the housing, a rod attached to the cam follower, the rod being extended by the cam follower for insertion into a door. The combination comprises an outer tube into which the rod is inserted, the outer tube being secured to a portion of the housing above the cam follower. The rod extends into a bottom portion of the door pushing a second rod upward within the door and into a door frame above the door. The sprocket of the cam comprises 36 teeth around the circumference of the sprocket. The door lock comprises a manual override cable, the cable connects to a control box mounted in a wall near the door.

The objects are further accomplished by a method of providing a security door lock for mounting under a door comprising the steps of generating a signal to activate and to deactivate the door lock, extending a piston a first predetermined distance in response to the activate signal, with means connected to the signal generating means, the piston extending means being attached to a housing for the door lock, moving a first rod a second predetermined distance in a direction opposite the direction of the piston with means attached to the piston extending means, and attaching the first rod to the means attached to the piston extending. The method comprises the step of inserting the rod into a hollow tube for lock strength, the hollow tube being attached to the housing. The method comprises the step of providing a second elongated rod within the door and positioning the first rod to push the second rod upward out of the door and into a door frame above the door.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
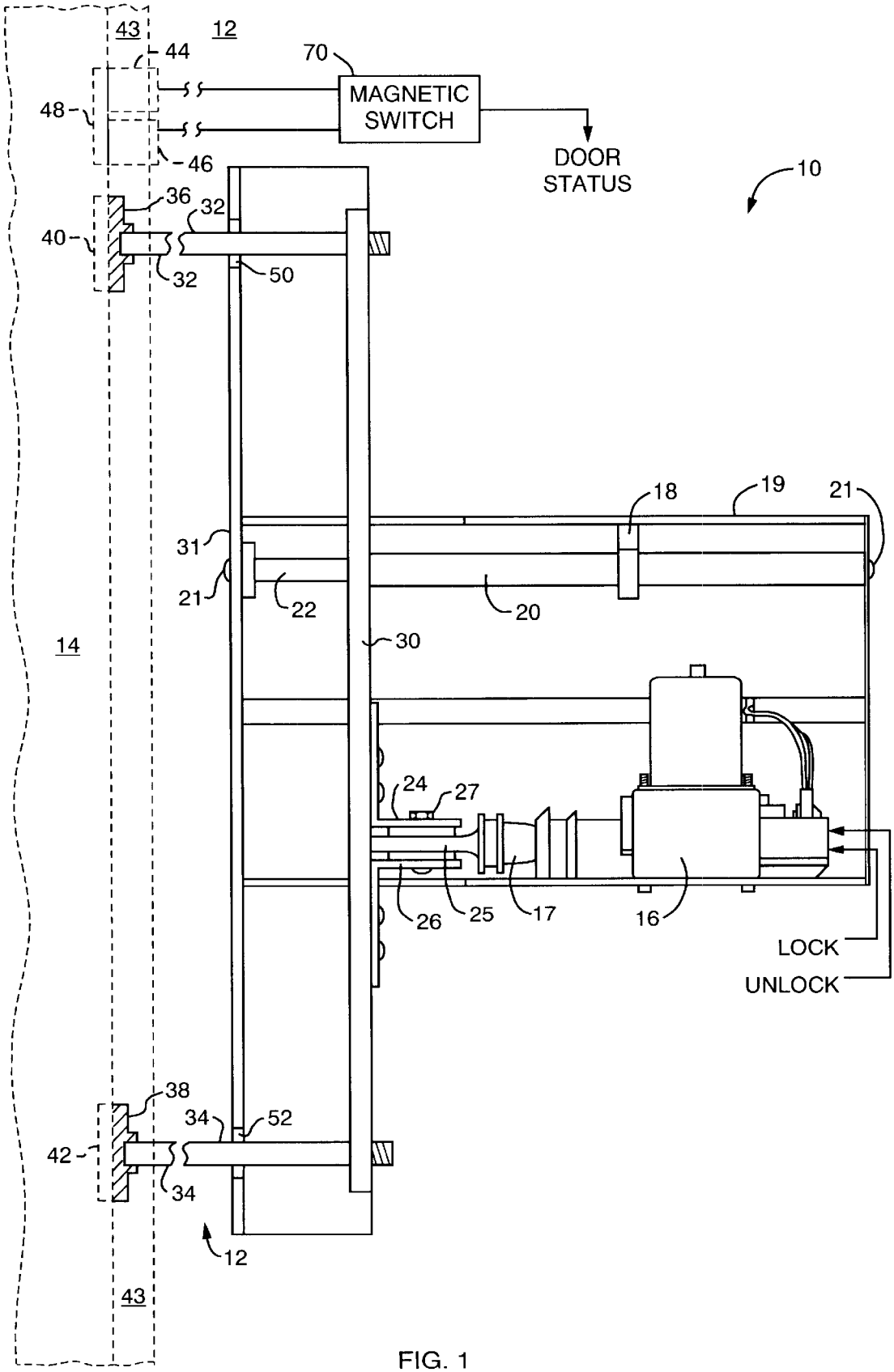
FIG. 1 is a side elevational view of the invention in an unlocked state with a side cover removed positioned in a wall adjacent to a door.

Referring to FIG. 1 a side elevational view of an invention of an electrically operated, strong, security lock 10 is shown in an unlocked state installed in a wall 12 adjacent to a door 14 and a door frame 43. The security lock 10 comprises an enclosure 19 typically made of aluminum or plastic having attached therein an actuator 16. Extending from one side of the actuator 16 is a piston 17 which has a piston extension 25 extending away from the actuator 16. First ends of right angle brackets 24, 26 attach to opposite sides of the piston extension 25 by means of a bolt and nut 27. The second ends of the right angle brackets 24, 26 attach to a rod holder bar 30 which is positioned perpendicular to the piston extension 25.

Two rods 32, 34 extend from opposite ends of the rod holder bar 30 and protrude into jam plates 36, 38 which are installed in the door frame 43 at the appropriate locations to receive rods 32, 34. The rods 32, 34 screw into threaded holes at the opposite ends of the rod holder bar 30. The rods 32 and 34 extend through holes 50, 52 of an end panel 31 of enclosure 19.

Figure 2:
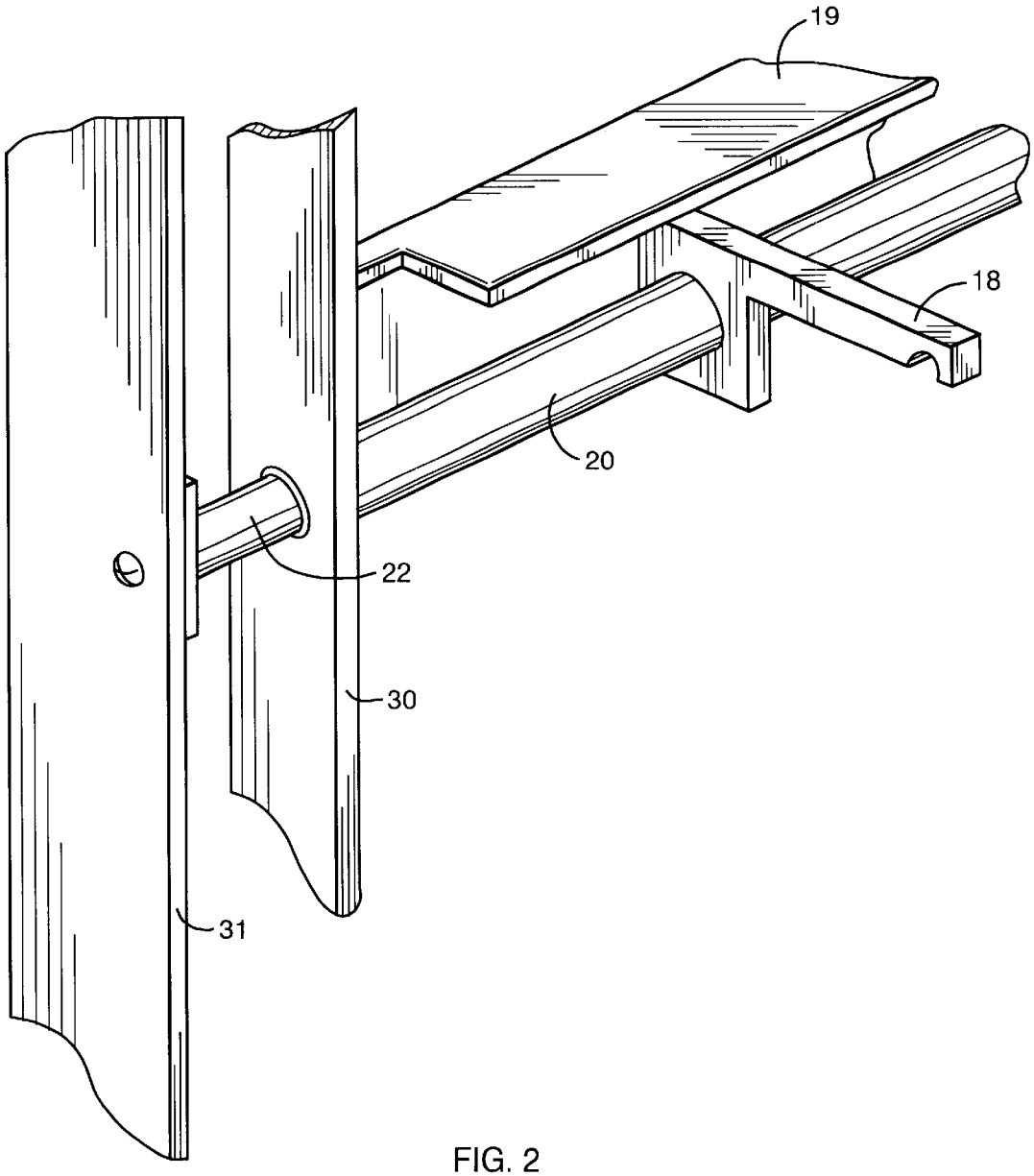
FIG. 2 is a perspective view of a lever for manually unlocking the switch and shows a stabilizer bar protruding through a lower portion of the lever.

Referring now to FIG. 1 and FIG. 2 a stabilizer bar 22 is positioned across the upper portion of the enclosure 19 above the actuator 16. The stabilizer bar 22 is attached by screws or bolts 21 between the right side of the enclosure 19 and the left side comprising end panel 31. A sleeve 20 surrounds the stabilizer bar 22 whereby one end of the sleeve 20 is attached to the rod holder bar 30 by a bend of weld. A lever 18 comprises the sleeve 20 passing through it with the handle portion of the lever 18 extending away from the sleeve 20 and perpendicular to it. The lever 18 is secured to the sleeve 20 by a bend of weld whereby moving the lever 18 towards the door 14 causes the rods 32, 34 to extend beyond the door frame 43 and into a door 14 when it is closed. The actuator 16 performs the same function of moving the rods 32, 34 which are attached to the rod holder bar 30 into the door 14 to lock it, when the actuator 16 receives a lock or activate signal from a receiver 80.

Figure 3:
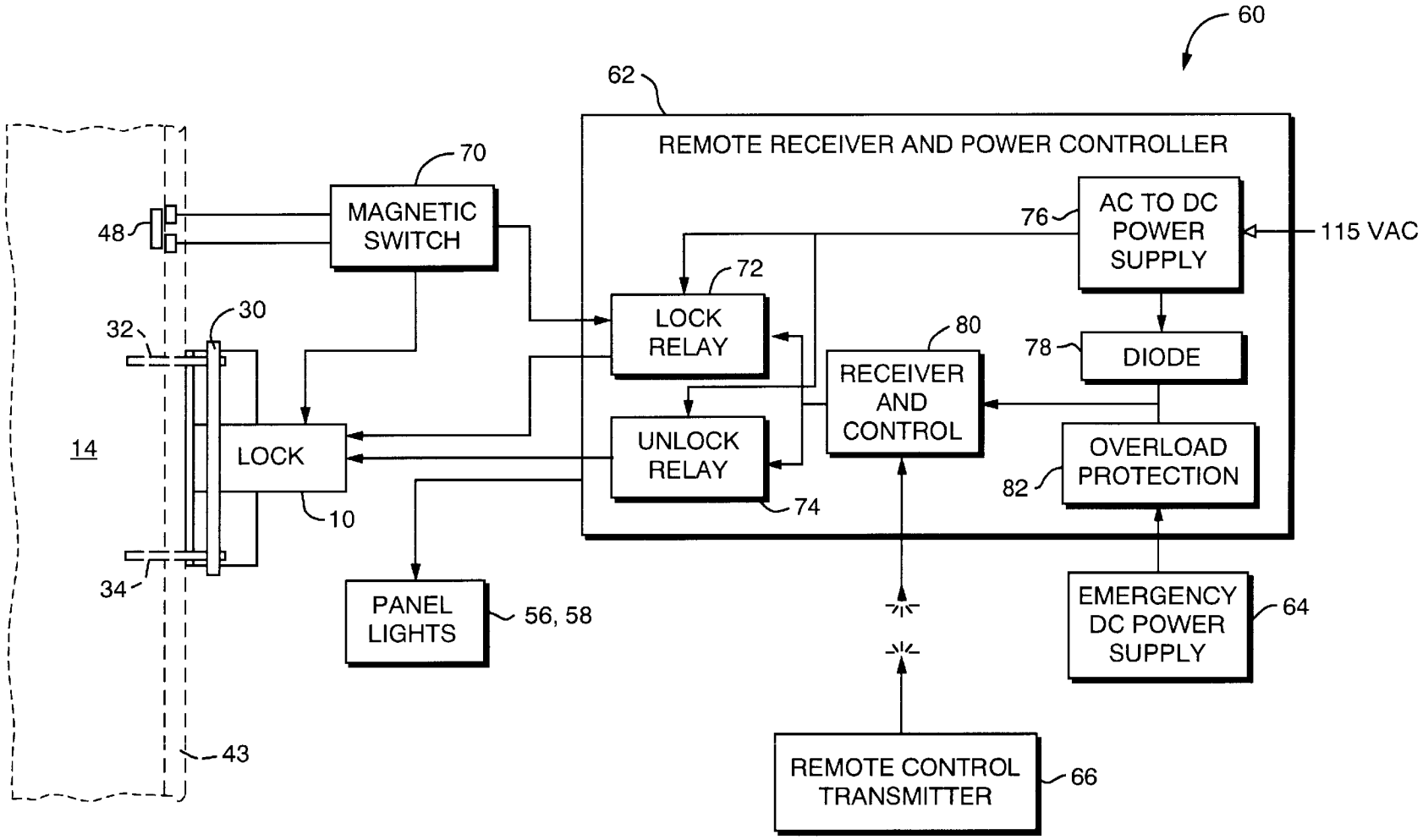
FIG. 3 is a system block diagram of a security door lock system showing the functional elements and their interconnections.

Referring to FIG. 3, a block diagram of a security door lock system 60 is shown comprising the lock 10 and other elements of the system which include a remote receiver and power controller 62, emergency DC power supply 64, remote control transmitter 66, wall panel lights 56, 58, and magnetic switch 70. The remote receiver and power controller 62 comprises a lock relay 72, an unlock relay 74, an AC to DC power supply 76, a diode 78, a receiver and control 80, and an overload protection 82.

The user of the security system 60 generally locks and unlocks the door 14 using the remote control transmitter 66, which may be embodied by a commonly available transmitter having four buttons as used with automobile door locks which provides for locking all doors, opening only a specific door, or turning on a light. The signal from the remote control transmitter 66 is received by the receiver and control 80 and decoded to open the lock 10, close the lock 10, and open or close selected other locks which may be installed for other doors of the house or building.

The magnetic switch 70 determines if the door is closed, prior to activating the remote control security lock 10. If it is closed, a signal is sent from the lock relay 72 to the lock 10 and from the magnetic switch 70 to the lock 10 wherein the actuator 16 is activated and moves the rods 32, 34 into the door 14, thereby locking the door 14.

Two magnetic sensors 44, 46 are positioned in the door frame 43 and a shorting plate 48 is installed opposite the magnetic sensors 44, 46 in the door 14. The magnetic switch 70 may be embodied by Model No. CKMPS9WGW manufactured by Sager Electronics of Waltham, Mass.

Emergency DC power is provided by a hand held emergency DC power supply 64 comprising eight (8) AA batteries commonly available from Radio Shack. This power supply enables operation of the electronic lock 10 when there is a primary power outage. The 12 volt power supply plugs into a receptacle at the remote receiver and power controller 62. The receptacle is wired to a common overload protection circuit 82.

The AC to DC power supply provides 12V DC to the system and is a commercial off-the-shelf (COTS) unit which may be embodied by model 3AMP13.8VDC, manufactured by Tandy Company of Fortworth, Tex. The receiver and control 80 decodes signals from the remote control transmitter 66 and generates signals for the lock relay 72 and unlock relay 74. When a lock relay signal is generated, the lock relay 72 becomes energized and sends a pair of signals to the lock 10. When an unlock relay signal is generated, the unlock relay 74 becomes energized and sends a pair of unlock signals to the lock 10. The lock relay 72 and unlock relay 74 may be embodied by model AROHL2HPCD12V, manufactured by Sager Electronics of Waltham, Mass. The receiver and control 80 may be embodied by model 725T manufactured by Directed Electronics, Inc. of Vista, Calif. Although specific parts have been described for implementing the preferred embodiment, one of ordinary skill in the art will recognize that other equivalent parts may also be used to implement the embodiment.

Figure 4:
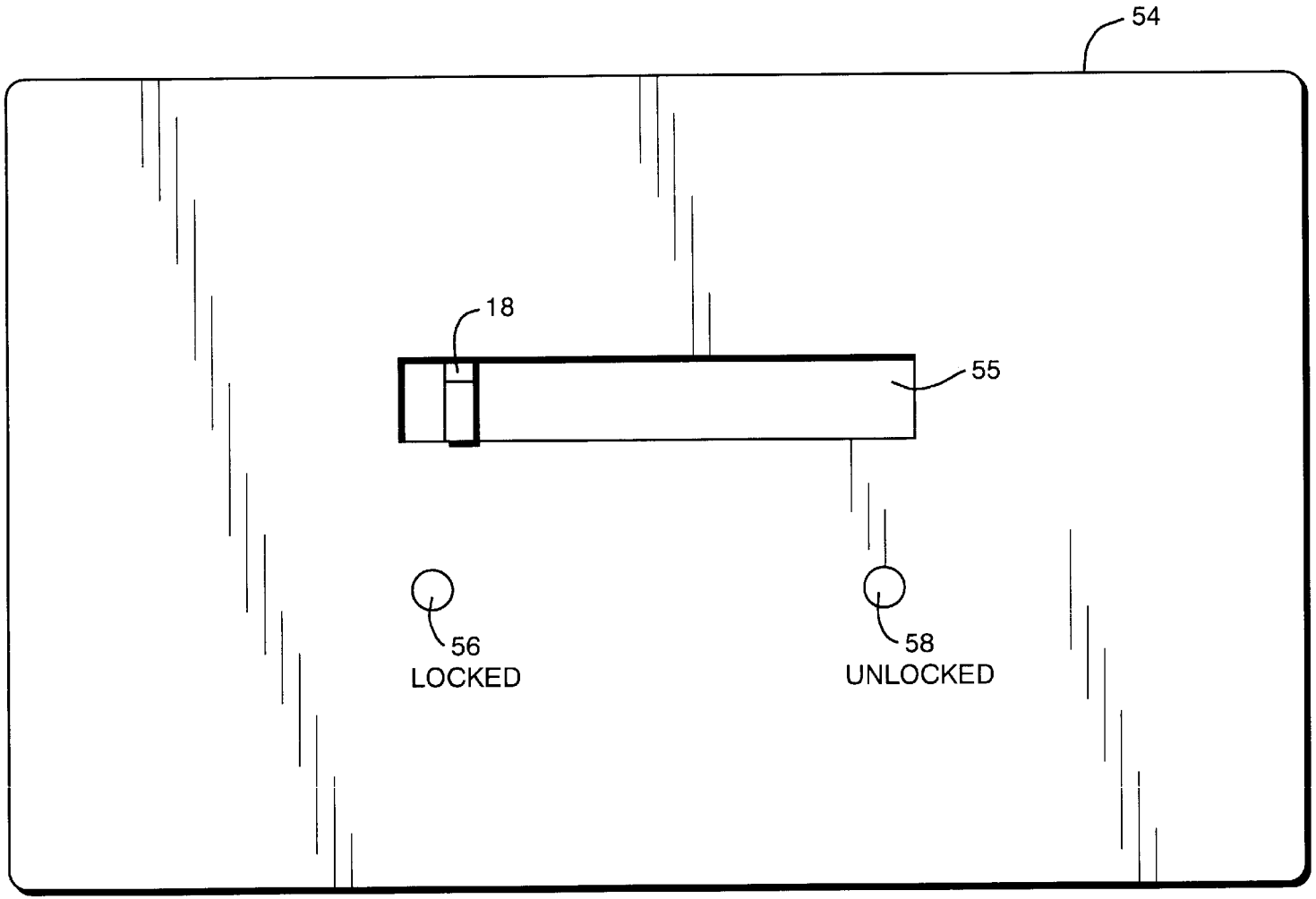
FIG. 4 is a side elevational view of the wall cover for the invention of FIG. 1 showing status lights and a lever for manually controlling the door lock.

Referring to FIG. 4 a wall panel 54 is shown having a rectangular opening 55 through which the lever 18 extends in order to enable the user to manually lock or unlock the security system. Two light emitting diode (LED) indicators 56, 58 are positioned under the opening 55 at each end of opening 55. In FIG. 4 the lever 18 is shown in the locked position, and the LED light 56, located under the lever 18, is green in color. It is turned on when the lever 18 activates a switch to apply voltage to the LED light 56. At the opposite end of the opening 55, the LED light 58 is red in color, and it is turned on when the lever 18 is moved to the UNLOCKED position activating another switch which applies a voltage to LED light 58.

Figure 5:
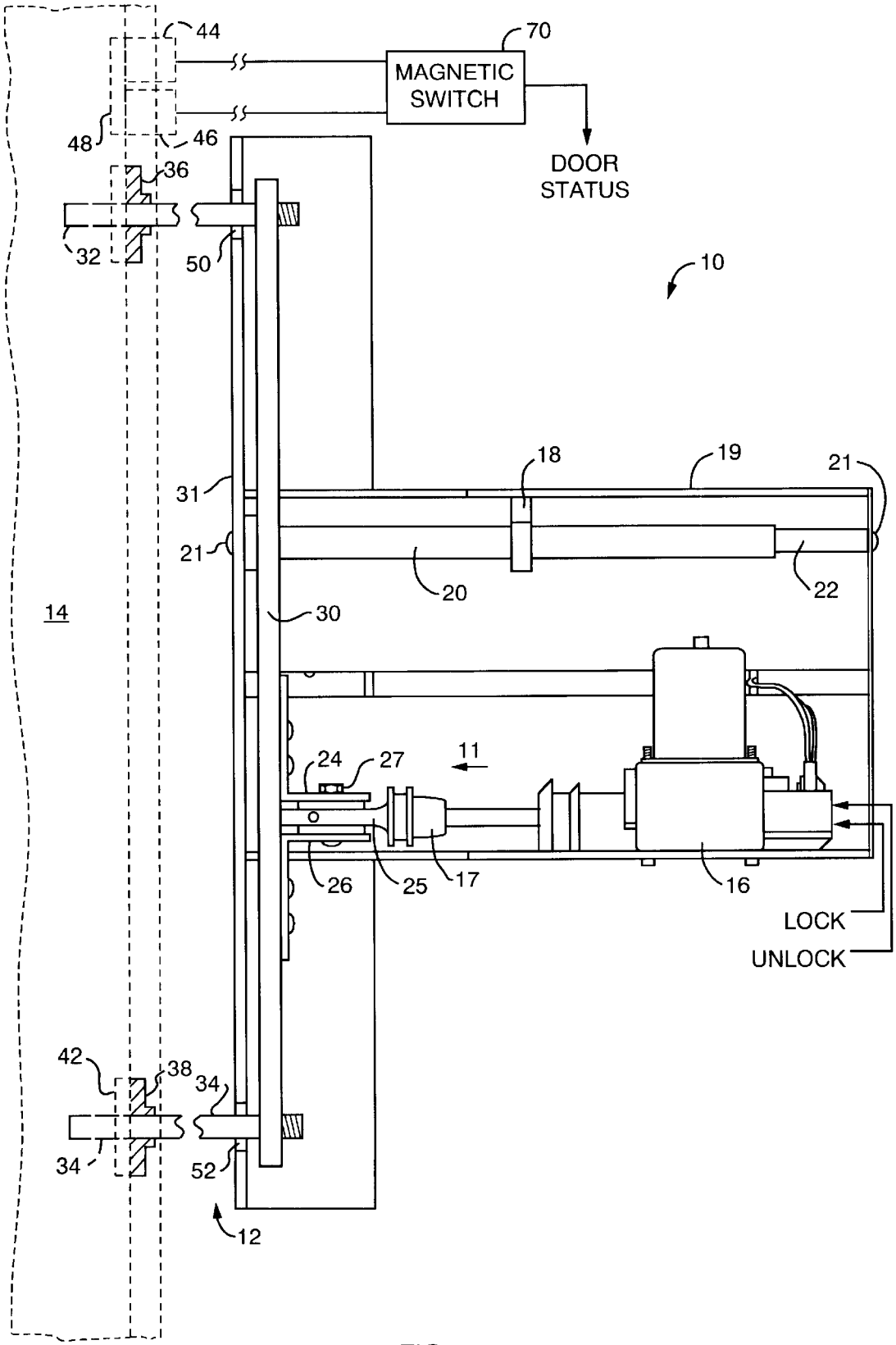
FIG. 5 is a side elevation view of the invention in a locked state with a side cover removed positioned in a wall adjacent to a door.

Referring now to FIG. 3 and FIG. 5, FIG. 5 shows a side elevational view of the lock of FIG. 1 in a locked state as illustrated by the rods 32, 34 extending into the door 14. The actuator 16 receives a signal from the lock relay 72 causing the piston 17 and the piston extension 25 to move away from the actuator 16 in the direction shown by the arrow 11. The rod holder bar 30 likewise is moved in the same direction causing the rods 32, 34 on opposite ends to move out of the door frame 43 and into the door 14.

First Alternate Embodiment

Figure 6:
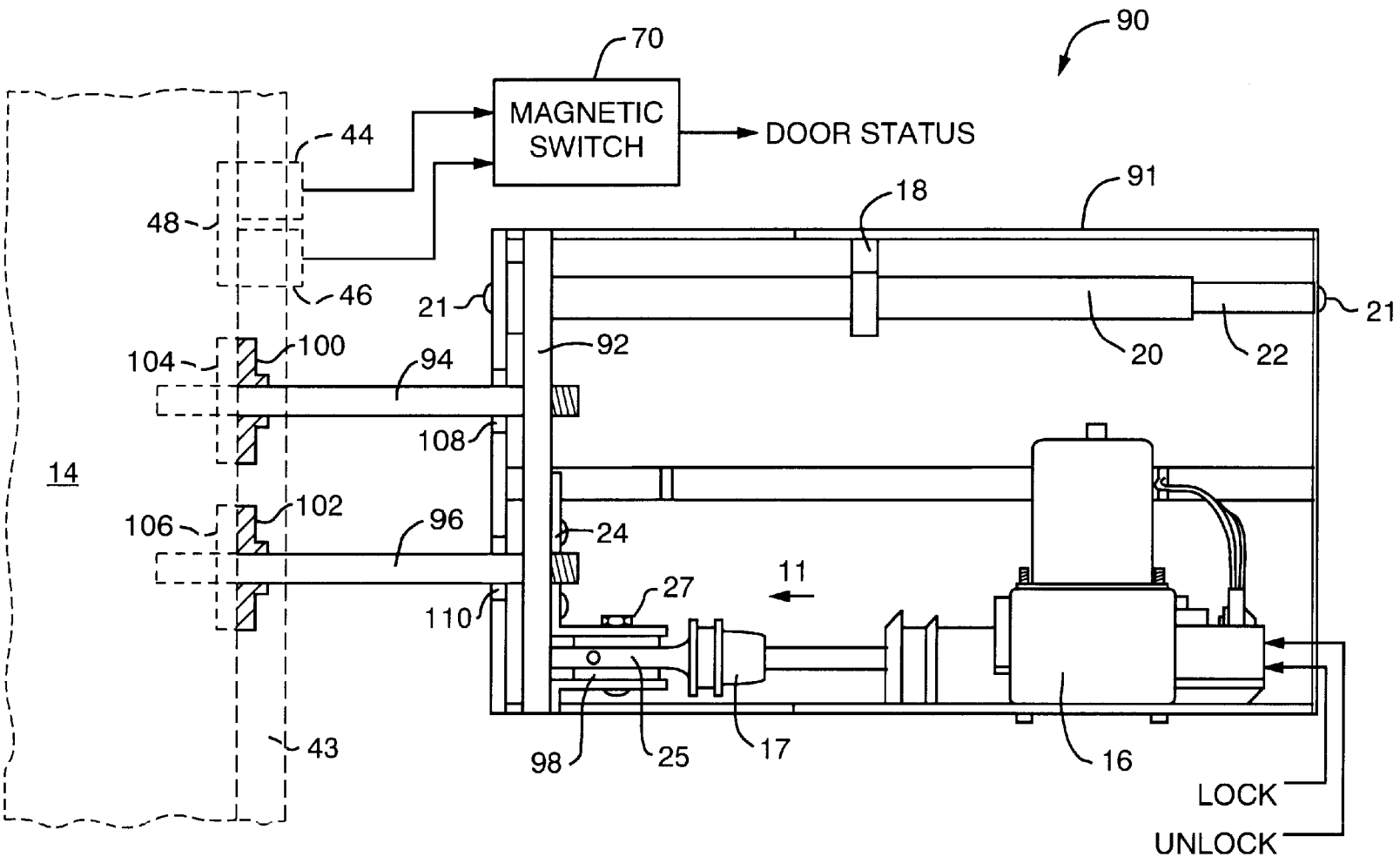
FIG. 6 is a side elevational view of an alternate embodiment of the invention with a side cover removed showing an arrangement of the locking rods close together for use where less space is available in a door or a wall.

Referring now to FIG. 6, a side elevational view of an alternate embodiment of the lock of FIG. 5 is shown with a side cover removed for use with doors having a design not suitable for the spacing of rods 32, 34 of FIG. 5. In this embodiment, the lock 90 comprises the enclosure 91, actuator 16, piston 17, piston extension 25, stabilizer bar 22, sleeve 20 and lever 18 which are the same components as those of lock 10 of FIG. 5. However, in this alternate embodiment the rod holder bar 92 is reduced in height to a maximum height to fit within the enclosure 91. The rods 94, 96 are positioned relatively close to each other near the center of the rod holder bar 92 into which they are secured, and the rod holder bar 92 is attached to the piston extension 25 by right angle brackets 24 and 98. The lock 90 is shown in the activated or locked state whereby the rods 94, 96 protrude into the door 14.

Still referring to FIG. 6, the rods 94, 96 protrude into jam plates 100, 102 which are installed in the door frame 43 positioned at the appropriate locations to receive rods 94, 96. Opposite the jam plates 100, 102 are door plates 104, 106 which guide the rods 94, 96 into the door 14 thereby securely locking the door 14.

Second Alternate Embodiment

Figure 7:
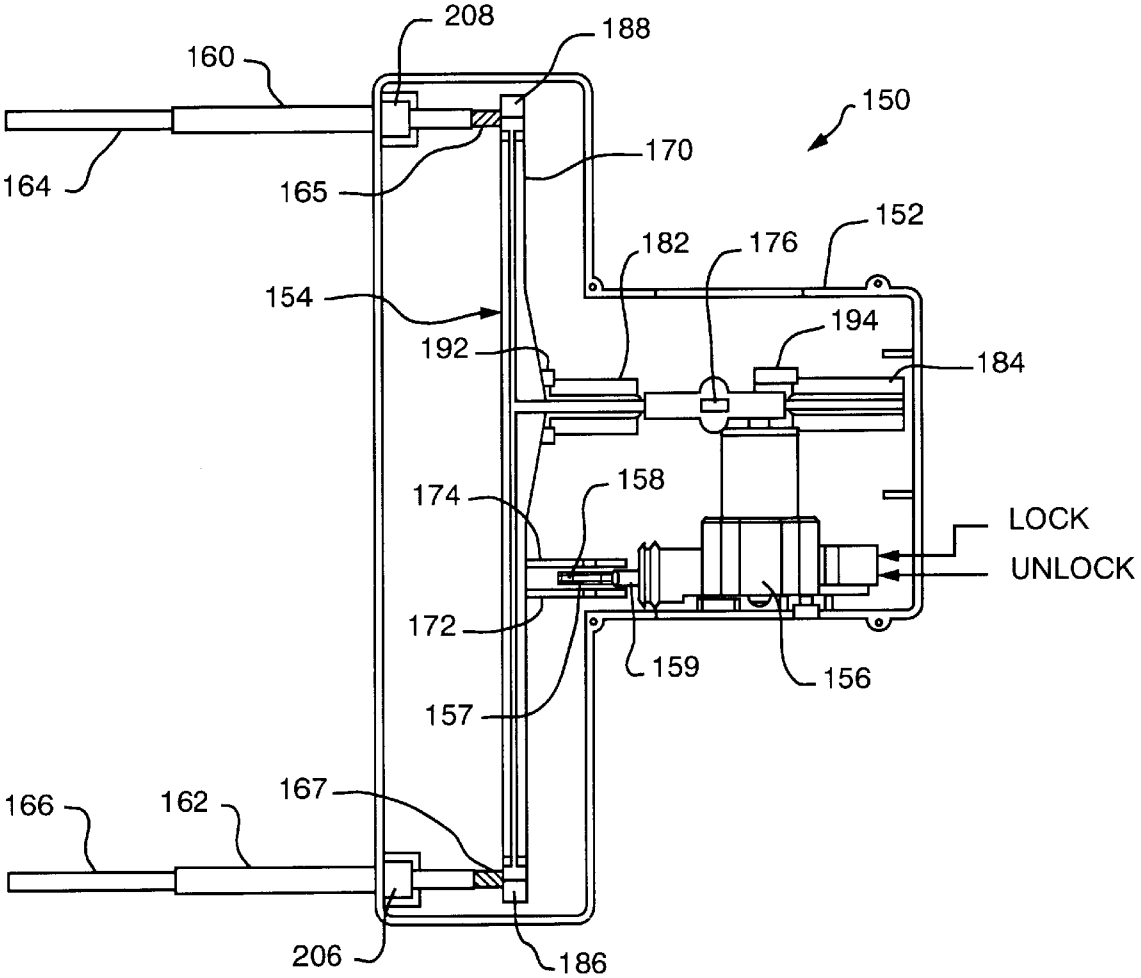
FIG. 7 is a side elevational view of an alternate embodiment of the security door lock shown in FIG. 1 in an unlocked state showing a molded housing and an integral rod holder bar.
Figure 9:
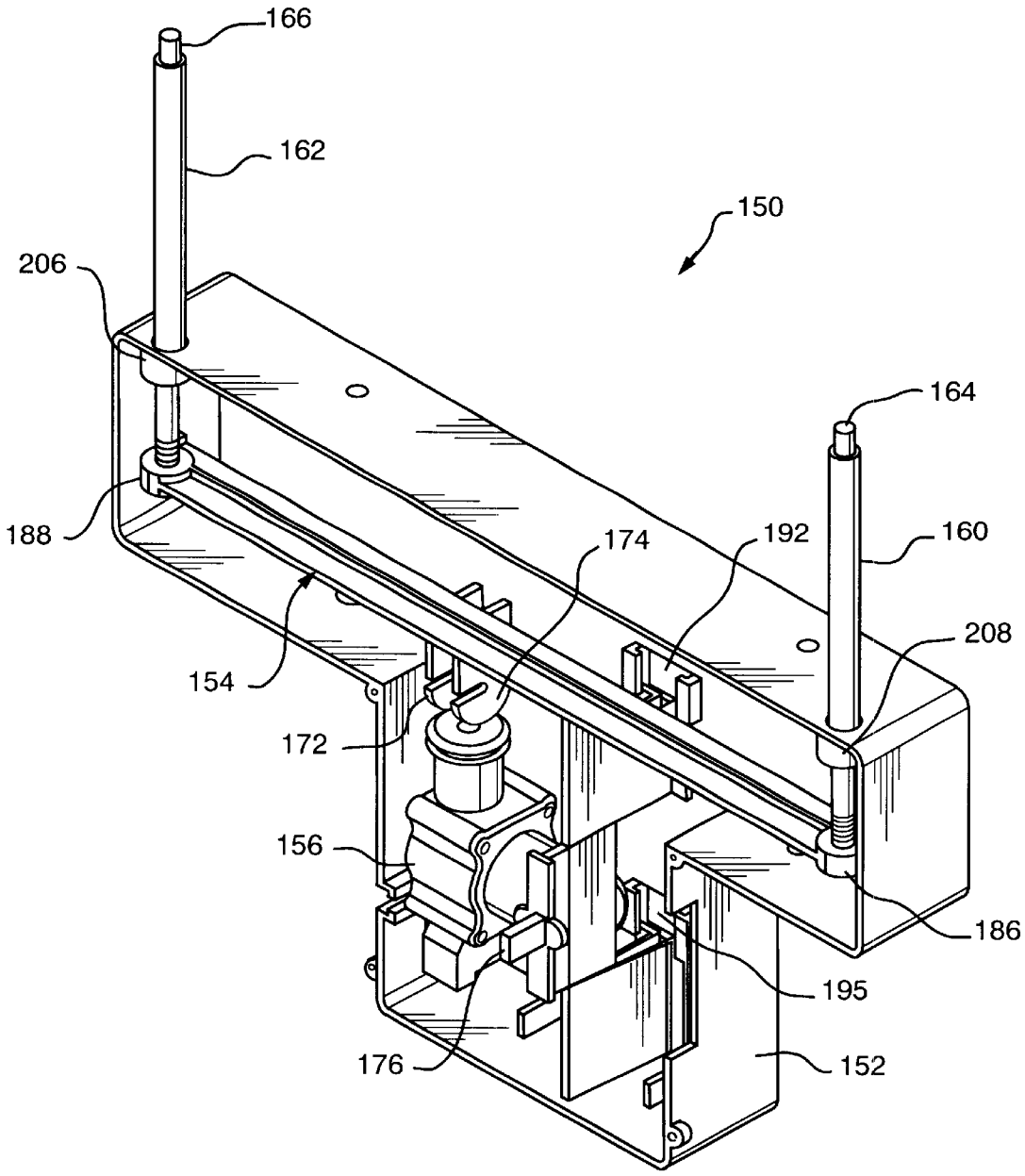
FIG. 9 is a perspective view of the security door lock of FIG. 7 in an unlocked state showing the integral rod holder bar having an extended lever for manual operation of the security door lock.

Referring to FIG. 7 and FIG. 9, FIG. 7 shows a side elevational view of a second alternate embodiment of the security door lock of FIG. 1 in an unlocked state with a cover (not shown) removed, and FIG. 9 is a perspective view of the security door lock of FIG. 7. The door lock 150 comprises a housing 152 that is made of molded plastic for producing a low cost security door lock. The lock housing 152 comprises an integral rod holder bar 154 which is also made of molded plastic for low cost, and an electrical actuator 156. Extending from one side of the actuator 156 is a piston 159 with a piston extension 158 for attaching to arms 172, 174 extending from the integral rod holder bar 154. Outer slider tubes 160, 162, which are threaded at one end, screw into spaced apart receptacles 206, 208 each positioned near corners of the front surface of the housing 152. An inner slider shaft 164, 166 is inserted into each of the outer slider tubes 160, 162 respectively and each shaft 164, 166 screws into the threaded receptacles 186, 188 of the integral rod holder bar 154. Both the inner slider shafts 164, 166 and the outer slider tubes 160, 162 are made of metal such as aluminum.

Figure 8:
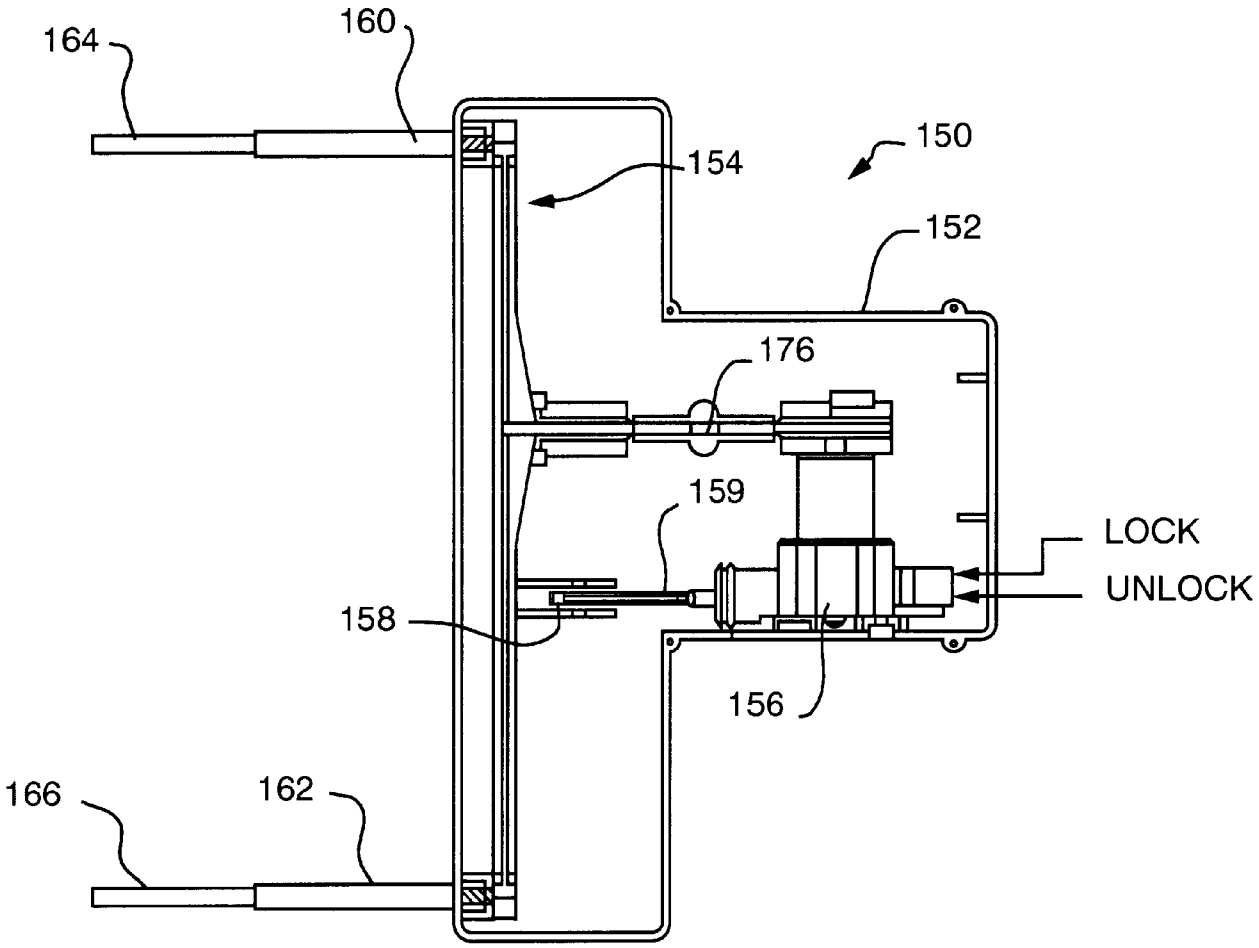
FIG. 8 is a side elevational view of the alternate embodiment of a security door lock of FIG. 7 in a locked state showing an integral rod holder bar extended by an actuator.

Referring to FIG. 7 and FIG. 8, FIG. 8 shows a side elevational view of the security door lock of FIG. 7 in a locked state. Comparing the locked state of FIG. 8 to the unlocked state of FIG. 7, in FIG. 8 the inner slider shafts 164, 166 are extended as a result of the integral rod holder bar 154 being extended by activation of the actuator 156 by a lock signal from the remote receive and power controller as shown in FIG. 2. Activation of the actuator 156 causes the piston 159 and piston extension 158, which attaches to the integral rod holder bar 154, to extend thereby moving the inner slider shafts 164, 166 further out of the outer slider tubes. When the security door lock 150 is mounted in a wall for locking a door, the slider shafts 164, 166 enter into a door similar to the rods 32, 34 in FIG. 5 extending into the door 14.

Figure 10:
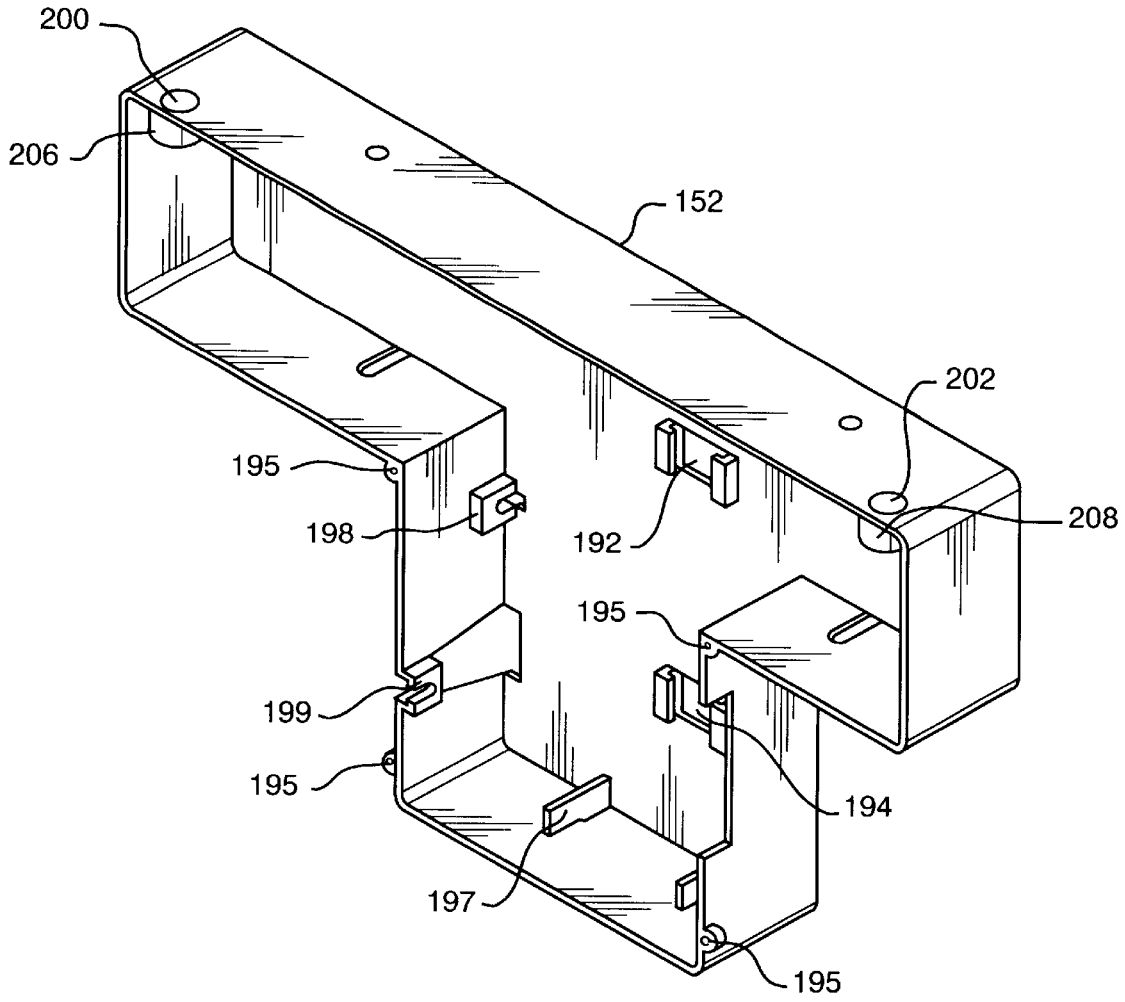
FIG. 10 is a perspective view of the molded housing.
Figure 11:
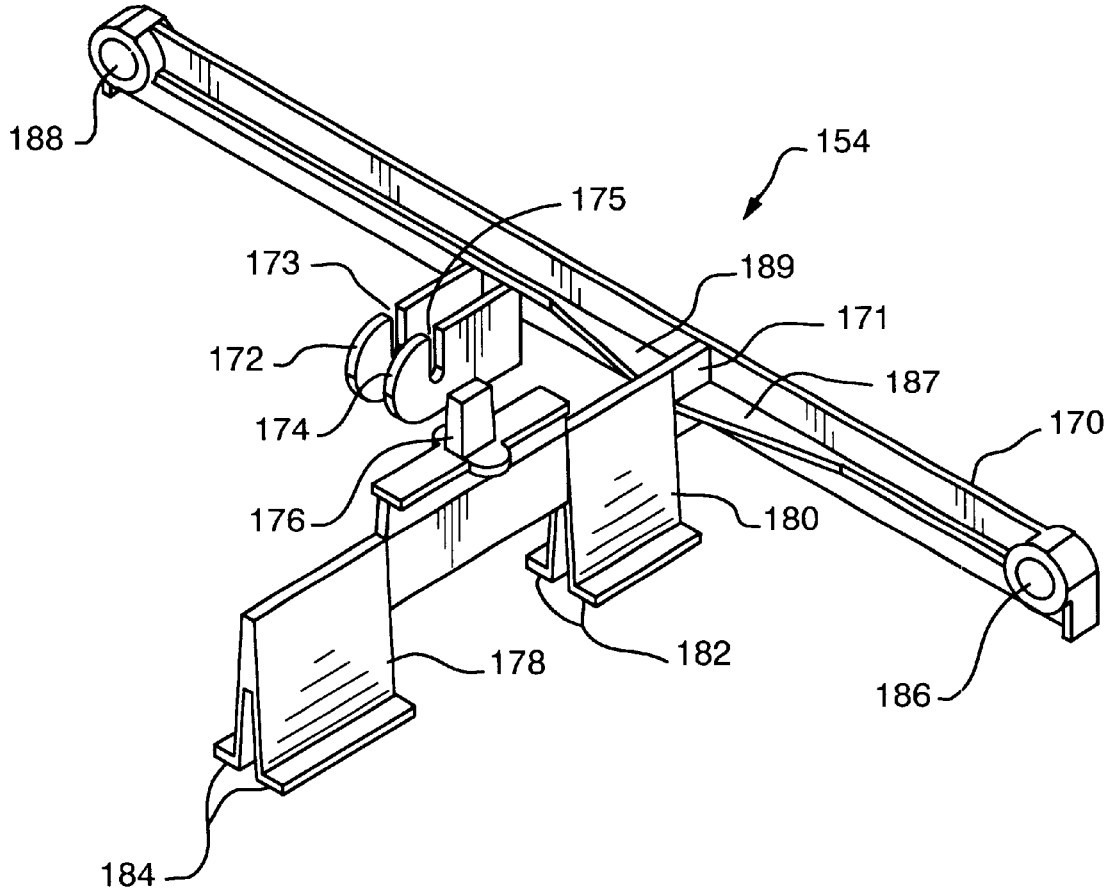
FIG. 11 is a perspective view of a molded integral rod holder bar.

Referring to FIG. 10 and FIG. 11, FIG. 10 is a perspective view of the molded housing 152. Although the cover is not shown, it is made of plastic similar to the housing and it generally has a square shape and is mounted on the outside of the wall to cover the housing 152. A slot is provided in the cover similar to the wall cover of FIG. 4 so that a lever 176 protrudes through the slot for manual operation of the door lock 150 in case of a power failure. FIG. 11 is a perspective view of the molded, integral, rod holder bar 154 which comprises the bar 170, piston extension retainers 172, 174 and a bar stabilizer 171 integrally attached perpendicular to the bar 170. The bar stabilizer 171 comprises the lever 176 mounted on top for manual operation of the door lock 150. Two wings 187, 189 are provided at the point of the integral connection of the stabilizer 171 and the bar 170 for structural stability of the molded integral rod holder bar 154.

The molded, integral, rod holder bar 154 is held in position within the housing 152 by flange holders 192, 194 positioned on the wall of the housing to receive the flanges 182, 184 on the bottom of the bar stabilizer 171. When the door lock 150 is activated either electrically or manually, the flanges 182, 184 slide within the flange holders 192, 194 respectively. One side of the actuator 156 is secured in the housing 152 using retainers 198, 199 and positioner flange 197.

Referring again to FIG. 7, FIG. 10 and FIG. 11, the piston extension 158 of the actuator 156 comprises an axial 157 that fits within the grooves 173, 175 of piston extension retainers 172, 174 respectively. Holes 200, 202 in the front of the housing 152 provide access for the outer slider tubes 160, 162 to be screwed into housing receptacles 206, 208. The molded housing 152 and the molded rod holder bar 154 facilitate quick assembly of the security door lock of FIG. 7.

Figure 12:
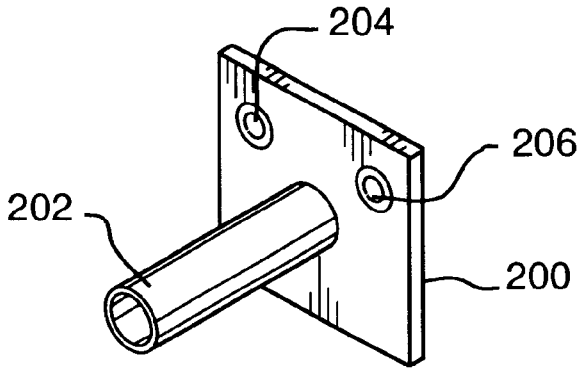
FIG. 12 is a perspective view of a door jam plate.

Referring to FIG. 12 a perspective view is shown of a door jam plate 200 for installation in a door frame. The door jam plate 200 comprises two mounting holes 204, 206 and a cylindrical extension 202 for insertion into the door frame and for guiding the slider shafts 164, 166 through a door jam or frame such as is accomplished by jam plates 100, 102 in FIG. 6. However, the cylindrical extension 202 is considerably longer on jam plate 200 for providing more strength and protection against attempted forced entry of the bar having such a security door lock.

Figure 13:
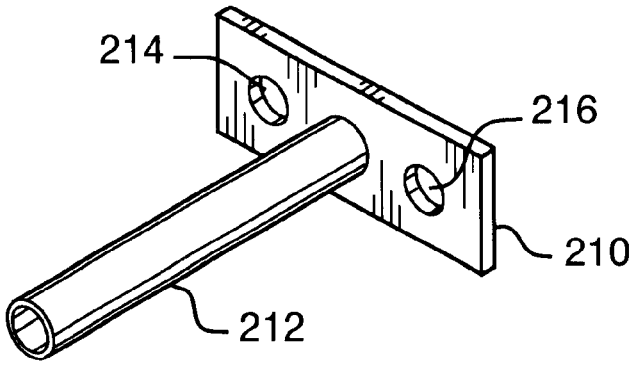
FIG. 13 is a perspective view of a door plate.

Referring to FIG. 13, a perspective view of a door plate 210 is shown which is generally rectangular in shape to facilitate mounting on a door. The door plate 210 comprises two mounting holes 214, 216 for receiving screws and a cylindrical extension 212 for insertion into the door and for receiving the slider shafts 164, 166 protruding into the cylindrical extension 212 of door plates 210. The slider shafts 164, 166 protruding into the cylindrical extension 212 accomplishes the actual locking of a door such as is illustrated in FIG. 5 which shows rods 32 and 34 protruding into door 14.

Third Alternate Embodiment

Figure 14:
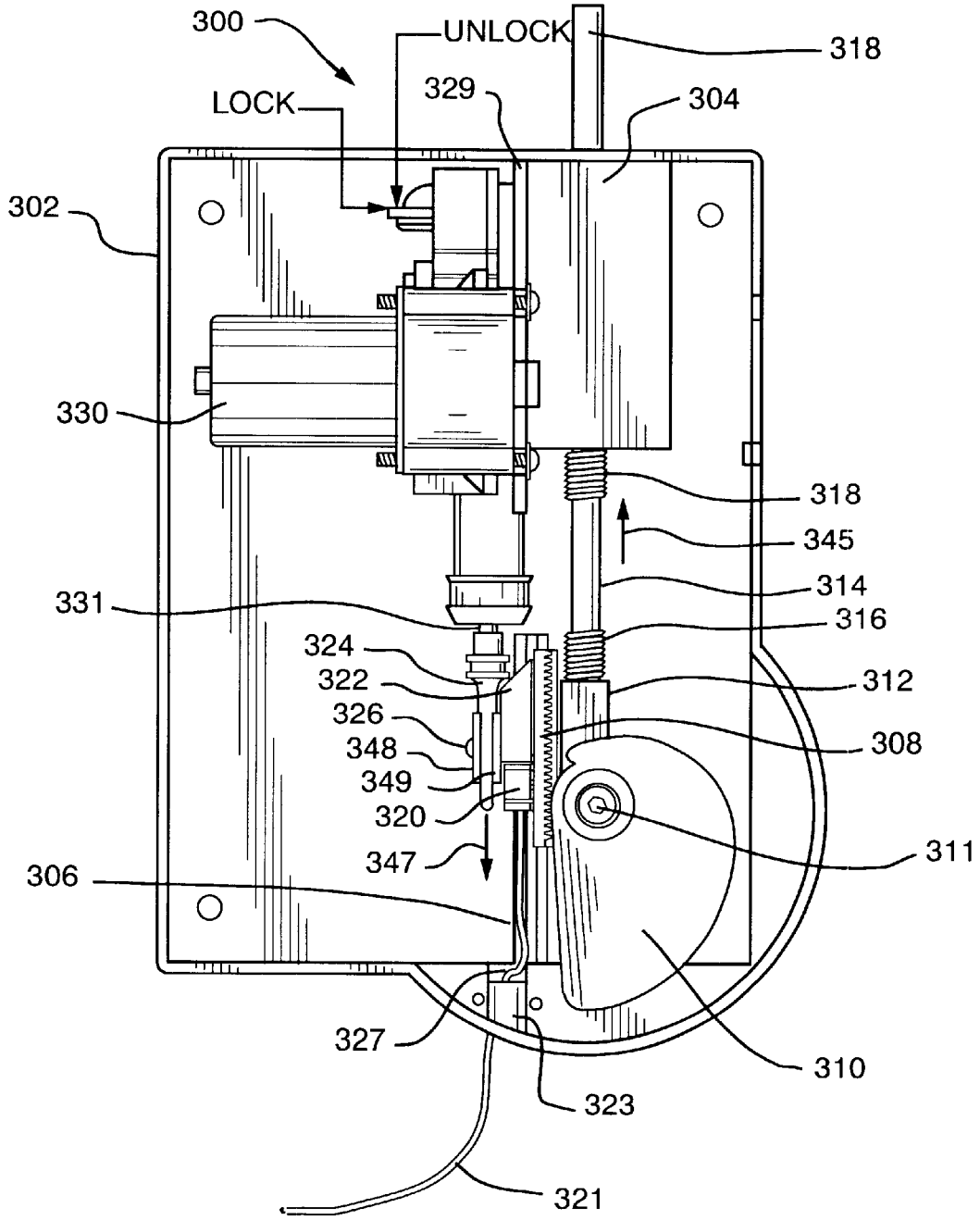
FIG. 14 is a front elevational view of a second alternate embodiment of the security door lock of FIG. 1.
Figure 15:
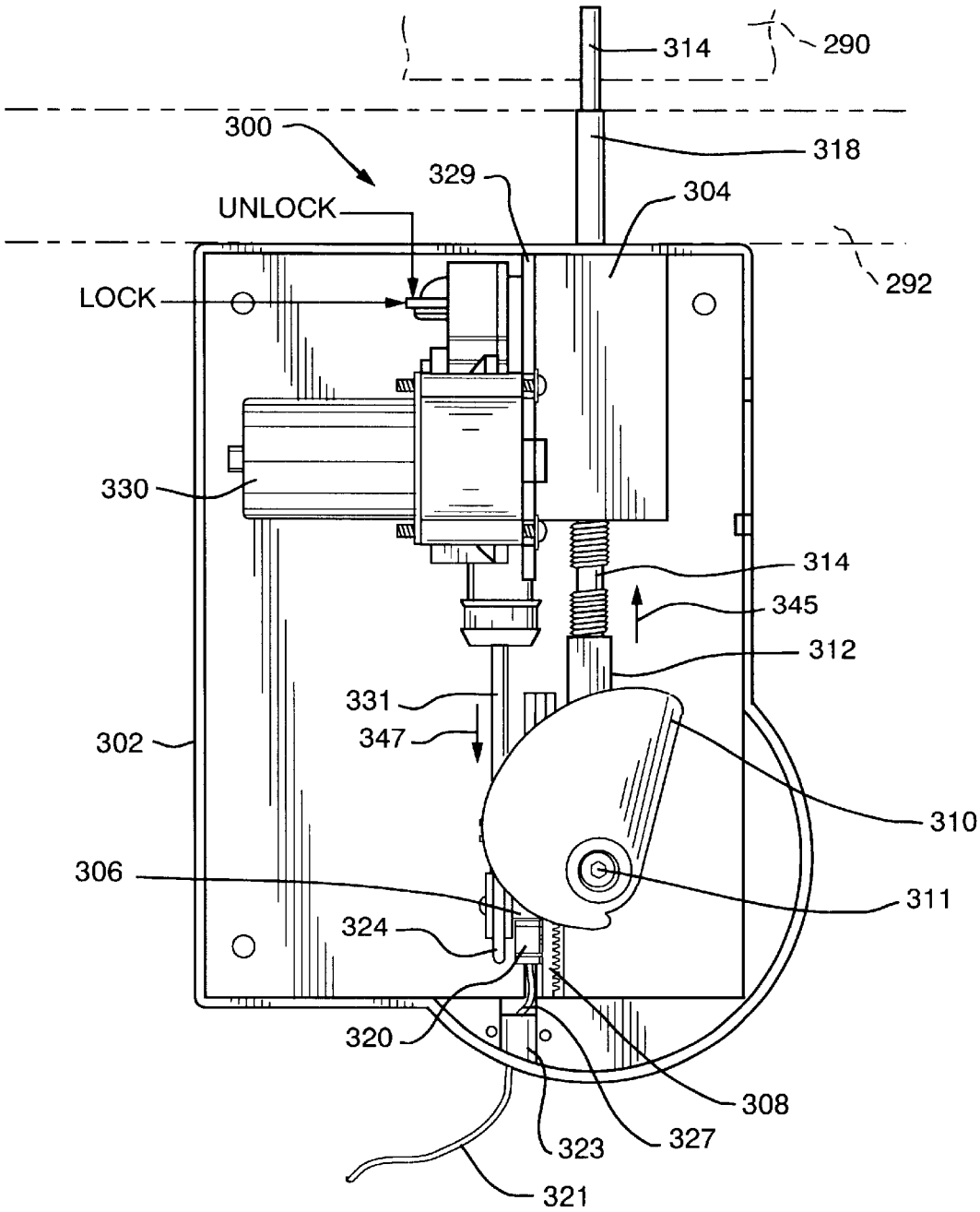
FIG. 15 is a front elevational view of the invention of FIG. 14 in a locked state with its front cover removed.

Referring now to FIG. 14 and FIG. 15, FIG. 14 is a front elevational view of a third alternate embodiment of the security door lock which is an underfloor door lock 300. The underfloor door lock 300 is shown in FIG. 14 in an unlocked state with its front cover removed disclosing its internal components. Such an underfloor door lock 300 is particularly useful when a door such as a front entrance door to a house has considerable glass either in the door or around the door frame preventing the use of the embodiment of a security door lock, as shown in FIG. 1, which mounts in the wall adjacent to the door. FIG. 15 is a front elevational view of the underfloor door lock of FIG. 14 showing the invention with its cover removed in a locked state. The door lock 300 is installed directly under a floor 292 which is directly under a closed door 290. In the locked state a locking rod 314 extends up into the bottom of the door 290, thereby preventing the door 290 from being opened. The underfloor door lock 300 comprises a housing 302, an actuator 330 having a piston 331, a piston extension 324, a rack 308, a cam 310, a cam follower 312, a lock shaft 314 and an outer tube 318. In addition, a manual override cable 321 runs from the housing 302 up to a convenient wall box near the door 290 where the remote receiving and power controller 62 as shown in FIG. 3 is located. The wire 327 in the cable 321 is attached to a lever (not shown) which actuates the wire 327 within the cable 321 and manually locks or unlocks the door lock 300 especially in cases of power failure. FIG. 3 shows the wall cover 54 with the lever 18 protruding through the slot 55 for the manual operation.

Figure 16:
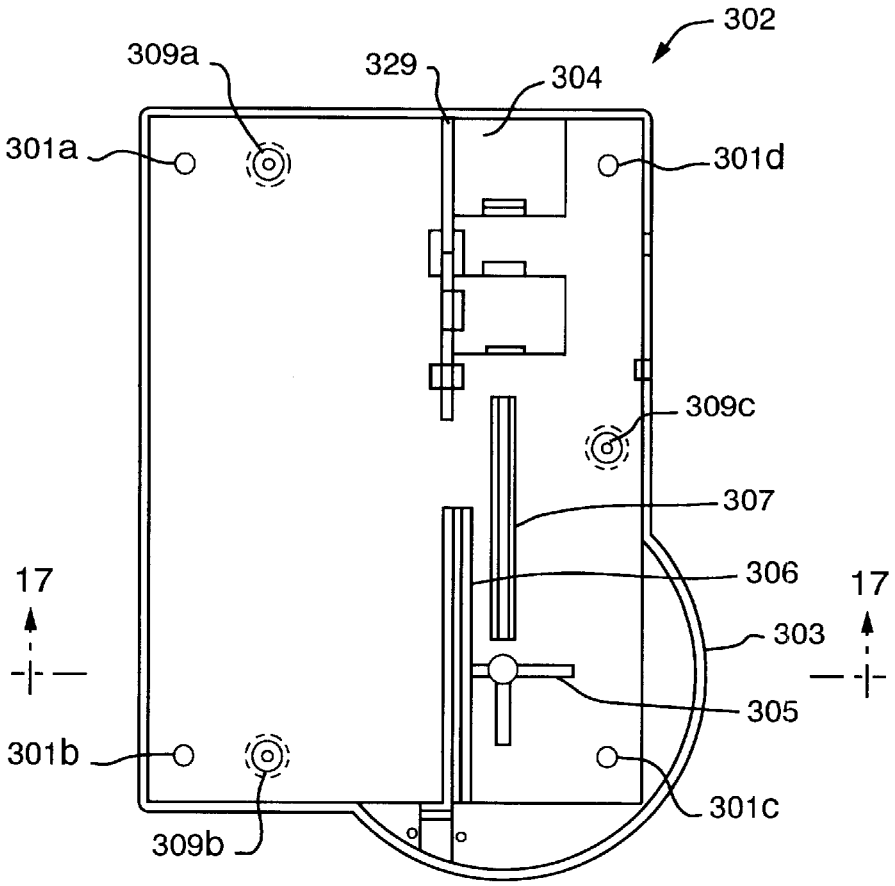
FIG. 16 is a front elevational view of the housing.
Figure 17:
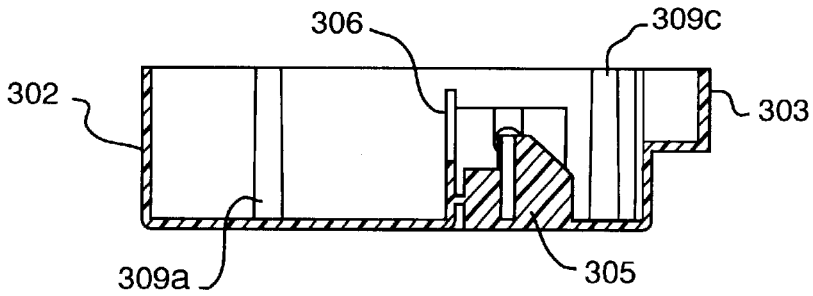
FIG. 17 is a bottom sectional view of the housing.
Figure 25:
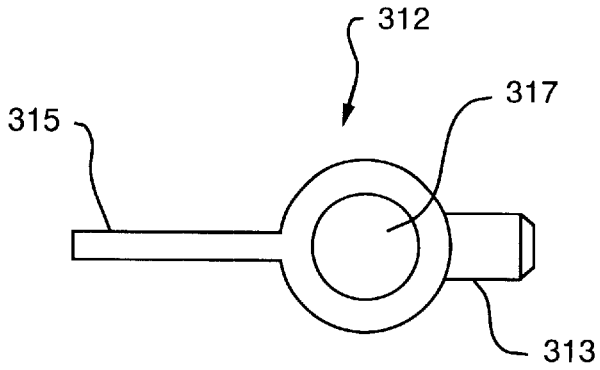
FIG. 25 is a top view of the cam follower of FIG. 24.

Referring to FIG. 16 and FIG. 17, FIG. 16 is a front elevational view of the housing which is embodied by molded plastic, and FIG. 17 is a bottom sectional view of the housing. The housing 302 comprises a rack guide channel 306 for receiving the rack channel insert 342 (FIG. 22) and a cam follower guide channel 307 for receiving the stabilizer 315 of cam follower 312 (FIG. 25). A cam support 305 is provided extending from the back wall below the cam follower guide channel 307. The top of the cam support 305 includes a threaded cylinder for receiving a bolt 311 extending from the outer surface of the cam 310. Three posts 309*a*, 309*b* and 309*c* are equally spaced within the housing 302 each having a threaded hole on top for receiving a screw to secure a protective cover on the front of the housing 302. Positioned in the upper right quadrant of the housing is a shelf structure for attaching the actuator 330 to a flanged surface 329. Cutouts are provided in the shelf structure for accommodating the shape of the actuator 330 and to enable securing the actuator 330 to the shelf structure 304. Four mounting holes 301*a*–301*d* are provided in the rear wall of the housing 302 for mounting the door lock housing 302 under the floor 292. An upper portion of the wall 303 of the housing 302 curves outward around the lower right corner of the housing 302 to provide space for the cam 310 to rotate within the housing 302.

Figure 18:
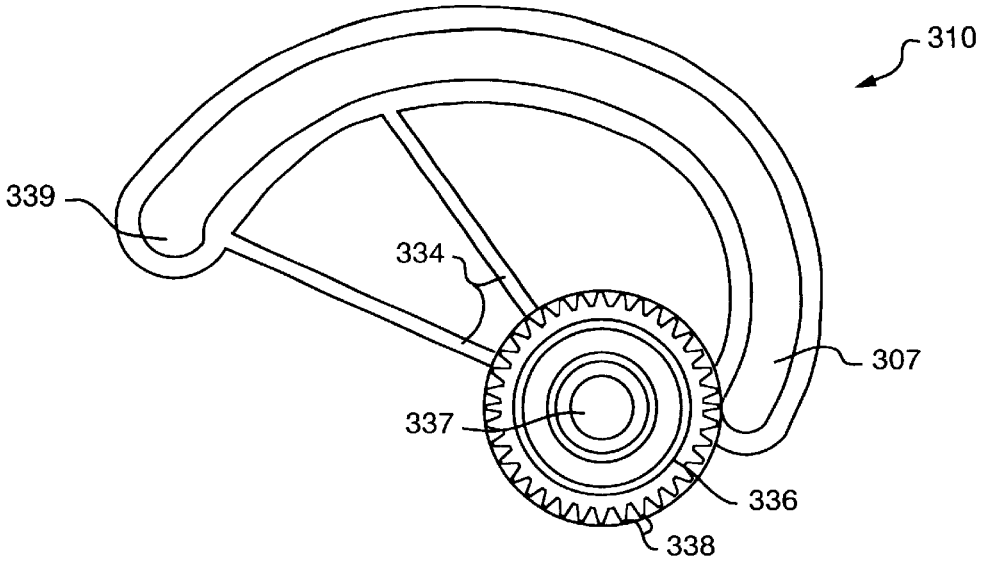
FIG. 18 is a front elevational view of a cam of the invention.
Figure 19:
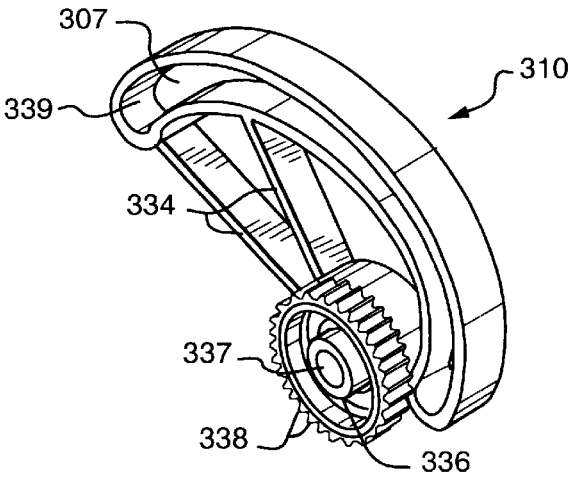
FIG. 19 is a perspective view of the cam of FIG. 18.
Figure 20:
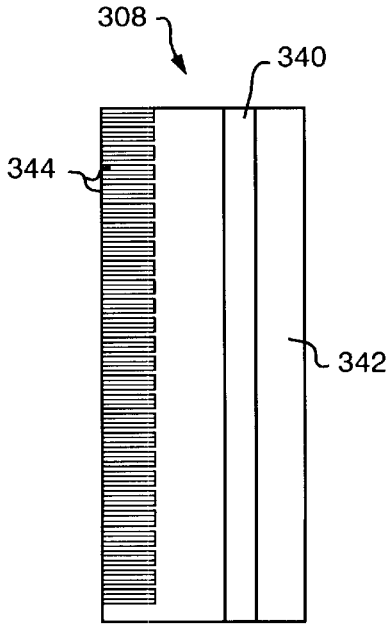
FIG. 20 is a front elevational view of a rack of the invention.
Figure 21:
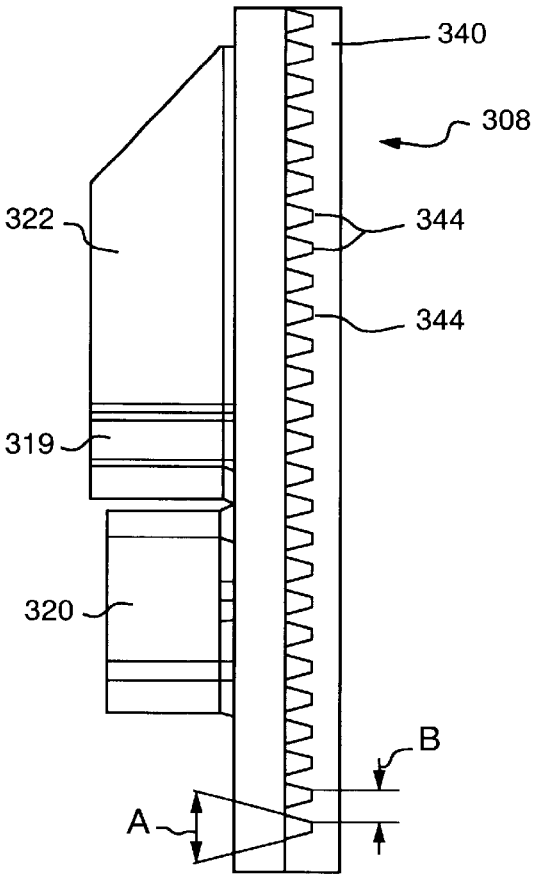
FIG. 21 is a side elevational view of the rack of FIG. 20.
Figure 22:
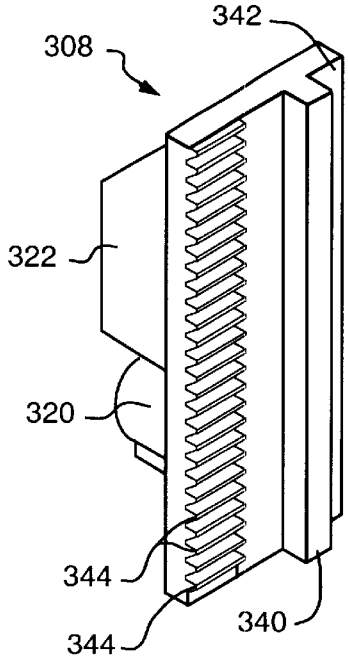
FIG. 22 is a perspective view of the rack.
Figure 24:
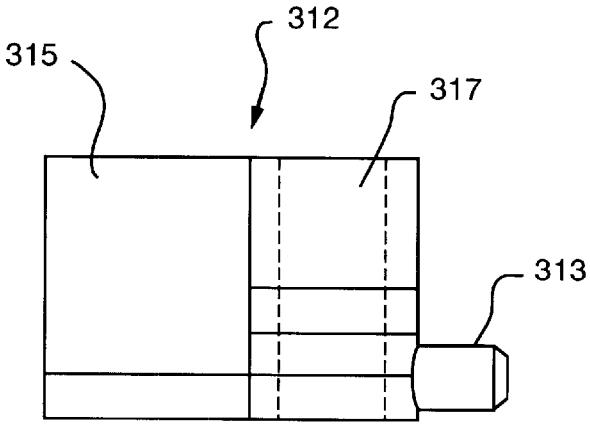
FIG. 24 is a side elevational view of a cam follower for insertion in the cam follower channel.

Referring to FIG. 18 and FIG. 19, FIG. 18 is a front elevational view of a cam 310 of the invention, and FIG. 19 is a perspective view of the cam 310. The cam 310 comprises a follower channel 307 having a predetermined arc, in accordance with space provided in the housing 302 and the required travel distance of the cam 310, and a sprocket 336 having a plurality of teeth 338 around the circumference of the sprocket 336. The number of teeth 338 on the sprocket 336 in the present embodiment is thirty-six (36), and the number of teeth 344 on a mating linear rack 308 (as shown in FIGS. 20–22) is twenty-six (26). The basic requirement is that the teeth 338 of the cam sprocket 336 interleave with the teeth 344 of the linear rack 308 and that the sprocket 336 rolls smoothly along the rack 308 when the rack 308 moves. The center of the sprocket 336 comprises a cylindrical hole 337 for receiving a bolt 311 for mounting the cam 310 on the cam support 305 provided in the housing 302. Two struts 334 provide structural support for the outer follower channel 307. The end 339 of the follower channel 307 has a slightly larger radius or detent so that when the cam 310 is fully rotated to extend the rod 314 to its maximum extension, a guide post 313 of the cam follower 312 (as shown in FIG. 24) temporarily locks in the detent end 339 of the follower channel 307, thereby preventing the rod 314 from coming down prematurely. The force of the piston extension 324 being retracted after an UNLOCK signal is received, causes the cam 310 to rotate and the guide post 313 to move out of the detent end 339 and proceed along the follower channel 307.

Figure 23:
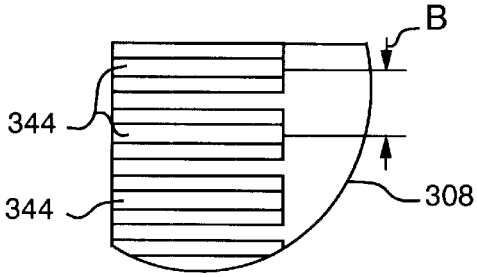
FIG. 23 is an enlarged view of a portion of the rack showing the spacing of the teeth on the rack.

Referring to FIGS. 20, 21, 22 and 23, FIG. 20 is a front elevational view of the rack 308 of the invention. FIG. 21 is a side elevational view of the rack 308, FIG. 22 is a perspective view of the rack 308 and FIG. 23 is an enlarged view of a portion of the rack 308 showing the spacing of the teeth 344 on the rack 308. The rack 308 functions in close cooperation with the cam 310. The rack 308 comprises a plurality of teeth along one side, a channel insert 342 on an opposite side of the rack 308 bordered by a channel stop 340 extending away from the main plain of rack 308 as shown in FIG. 22. The channel insert 342 fits within and slides along the rack guide channel 306 in the wall of the housing 302. The channel stop 340 rests on top of the rack guide channel 306. FIGS. 21 and 22 show a fin 322 and a wire fastener 320 attached to the back of the rack 308. FIG. 15 shows the wire 327 extending from a cable fastener 323 and terminating in the wire fastener 320. Above the wire fastener 320 and located on the back side of the fin 322 is a threaded cylindrical hole 319 for receiving a screw 329 for attaching the piston extension 324 to the rack 308. Rubber washers 348, 349 are positioned on each side of the piston extension 324 through which the screw 326 is inserted as shown in FIG. 14.

Referring to FIG. 21 and FIG. 23, FIG. 23 is an enlarged view of a portion of the rack 308 showing the spacing of the teeth 344. In the present embodiment the distance "B" between two teeth is 0.075 inches and the angle A between two sides of one of the teeth 344 is 30 degrees. Other dimensions of the teeth 344 of the rack 308 may be implemented providing appropriate dimensions are used for the teeth 336 of the cam sprocket 336 so that the cam 310 and rack 308 mesh smoothly to move the lock shaft 314.

Referring now to FIG. 24 and FIG. 25, FIG. 24 is a side elevational view of a cam follower 312 having a guide post 313 for insertion into the cam follower channel 307. FIG. 25 is a top view of the cam follower 312 having a threaded hole 317 which receives the threaded end 316 of the lock shaft 314 as illustrated in FIG. 14 and FIG. 15. The stabilizer 315 of the cam follower 312 is inserted into the cam follower channel 307 in the housing 302. As the cam 312 turns, the stabilizer 315 slides along the cam follower channel 307 moving the lock shaft 314 up or down and in or out of the bottom of the door 290 as illustrated in FIG. 15.

The teeth 338 of the cam sprocket 336 mesh with the teeth 344 of the rack 308 for smooth operation of moving the lock shaft 314.

Figure 26:
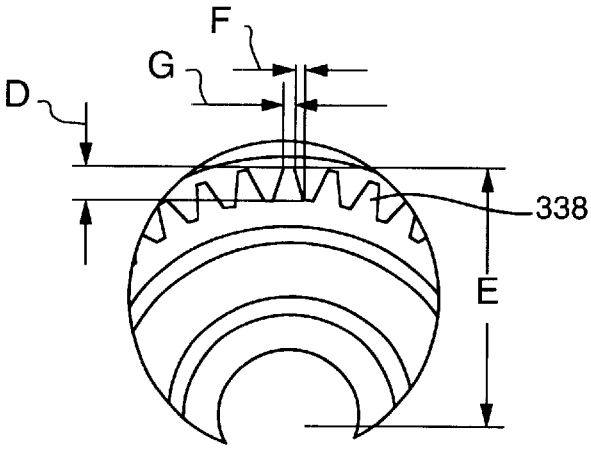
FIG. 26 is an exploded view of a portion of the sprocket of FIG. 18.

Referring now to FIG. 26, an exploded view is shown of a portion of the sprocket 336 showing the teeth 338 and details of the teeth 338 of the embodiment of FIG. 18. The height "D" of a tooth 338 is 0.060 inches; the distance "E" from the center of the hole 337 in the sprocket 336 to the top of the tooth 338 is 0.456 inches; the width "G" of the top of the tooth is 0.019 inches and displacement of the leading or trailing edge of the tooth 338 is 0.019 inches. As noted previously other dimensions of the teeth 338 may be implemented providing appropriate dimensions are used for the teeth 344 of the rack 308 so that the cam 310 and rack 308 mesh smoothly to move the lock shaft 314.

Referring again to FIG. 3, FIG. 14, and FIG. 15, the underfloor security door lock 300 operates when it receives control signals, LOCK and UNLOCK from the remote receiver and power controller 62 which receive control signals from remote control transmitter 66 shown in FIG. 3. When the underfloor door lock 300 receives the LOCK signal the actuator 330 extends a piston 331 out of the actuator in a downward direction 347 a fixed distance. The piston extension 324 which attaches to the end of the piston 331 is attached to the rack 308 by screw 326 and the teeth 344 of the rack 308 mesh or interleave with the teeth 338 of the sprocket 336 on the back of cam 310. As the rack 308 is moved downward 347, the cam 310 rotates driving the cam follower 312 in an upward direction 345 as the guide post 313 of the cam follower 312 advances along the cam follower channel 307. Because the latch rod 314 is attached to the cam follower 312 the latch rod 314 moves in an upward direction 345 extending up into the bottom of the door 290.

The actuators 16, 156, and 330 used in the various embodiments described herein are identical and may be embodied by a commonly available device used as an actuator for power locks in a motor vehicle. The housing 302, and rack 308, cam 310 and cam follower 312 are made of plastic from molds for low cost manufacturing and assembly of the underfloor door lock 300.

Figure 28:
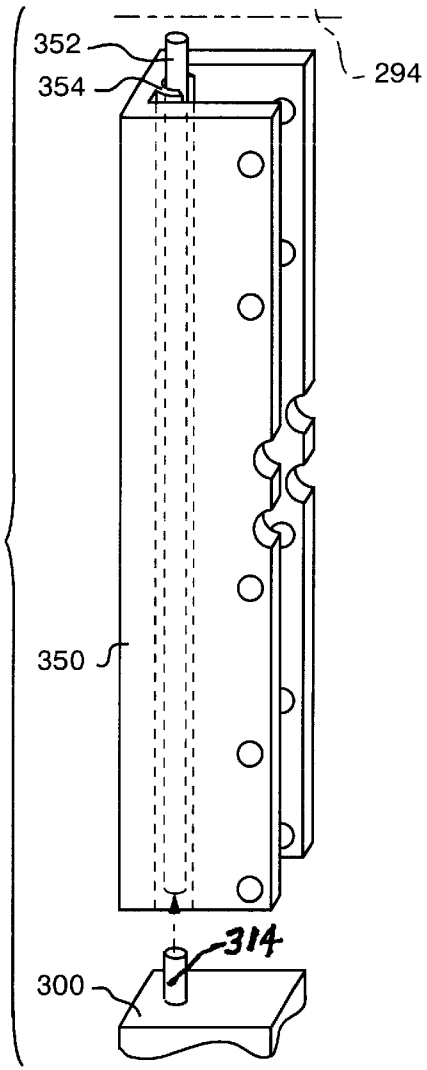
FIG. 28 is a perspective view of a door rod assembly used with an underfloor door lock.
Figure 29:
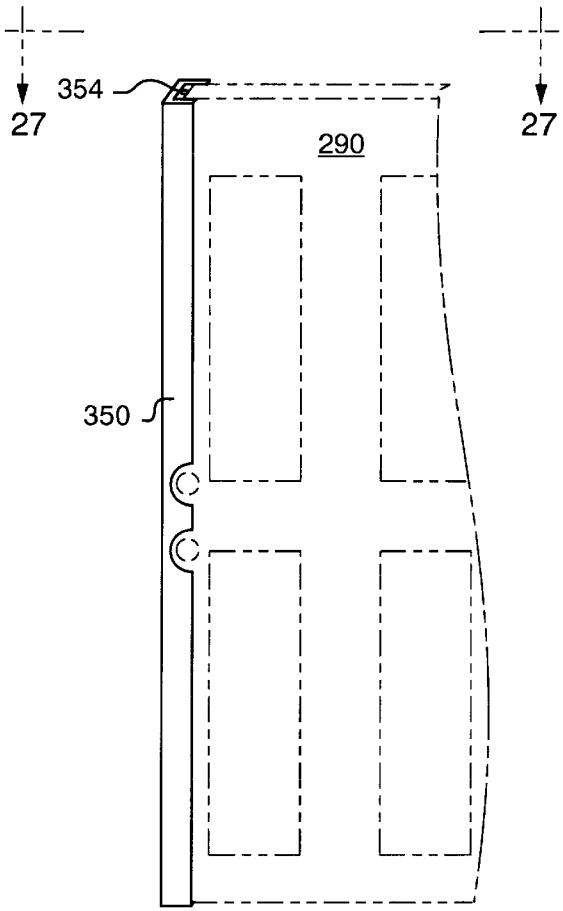
FIG. 29 is a perspective view of the door rod assembly attached to a door.
Figure 27:
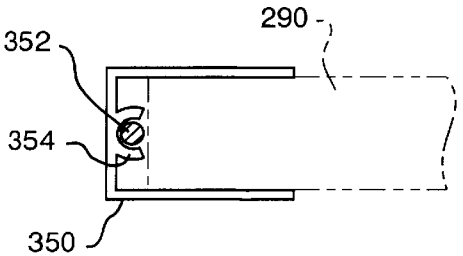
FIG. 27 is a top view of a door having a door rod assembly attached to a side.

Referring to FIGS. 27, 28, and 29, FIG. 27 is a perspective view of a door rod assembly 350 having a U-shaped design for mounting over the end of a door 290 after the door 290 has been trimmed by the thickness of the door rod assembly 350 to fit within the original dimensions of the door 290. FIG. 27 shows a top view of the door rod assembly 350 attached to the door 290 and FIG. 29 is a perspective view of the door rod assembly 350 attached to the door 290. An elongated rod 352 is positioned within the U-shaped door rod assembly 350 and is inserted within a semi-cylindrical section for ease of movement of the door rod 352 within the assembly 350. The door rod assembly 350 is a single extruded piece made of aluminum or other similar material. When the underfloor door lock 300 is activated, the rod 314 extends into the door rod assembly 350 pushing the door rod 352 upward to extend into the door frame 294 above the door 290, thereby locking the door at the top and the bottom.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A security door lock for mounting inside a wall comprising:

means for generating a signal to activate and to deactivate said door lock;

means, connected to said signal generating means for extending a piston a predetermined distance in response to said activate signal;

means attached to said piston for moving at least one rod said predetermined distance from a first position to a second position when activated, said rod returning to said first position when said lock receives said signal to deactivate;

means, attached to said moving means parallel to said piston, for stabilizing said moving means; and said stabilizing means being secured by retaining means attached to a wall of said door lock for allowing said stabilizing means to slide said predetermined distance when said piston is extended.

2. The security door lock as listed in claim 1 wherein said moving means comprises said one rod protruding from a first area and in parallel with another rod protruding from a second area.

3. The security door lock as recited in claim 1 wherein said means for extending said piston comprises an actuator.

4. The security door lock as recited in claim 1 wherein said moving means is attached to said piston with a pair of arms extending from said moving means.

5. The security door lock as recited in claim 1 wherein said signal generating means comprises:

means for transmitting a coded signal;

means for receiving and decoding said coded signal;

means for generating said lock activating signal in response to said decoded signal when said door is closed.

6. The security door lock as recited in claim 1 wherein said signal generating means comprises a remote control transmitter.

7. The security door lock as recited in claim 1 wherein said lock comprises means for sensing said door being closed before allowing said piston extending means to be activated.

8. The security door lock as recited in claim 1 wherein said lock comprises means, extending from said stabilizing means, for manually locking and unlocking said door lock.

9. A security door lock system for mounting inside a wall adjacent to a door and a door frame comprising:

a remote control transmitter for generating a coded signal;

receiver means for decoding said coded signal from said transmitter;

means for sensing that said door is closed;

means connected to said receiver means and said closed door sensing means for generating a lock control signal and an unlock control signal;

actuator means connected to said lock control signal generating means for extending a piston a predetermined distance in response to said lock control signal;

a rod holder bar attached to said piston for moving at least one rod said predetermined distance from a position in said door frame to a position inside said door in response to said actuator means receiving said lock signal, said at least one rod being retracted to said position in said door frame in response to said actuator means receiving said unlock control signal;

a bar stabilizer portion of said rod holder bar, attached approximately perpendicular to a bar portion of said rod holder bar and parallel to said piston, for stabilizing said rod holder bar, said bar stabilizer portion being positioned a predetermined distance away from said attachment of said bar portion to said piston; and said bar stabilizer portion being secured by retaining means attached to a wall of said door lock for allowing said rod holder bar to slide said predetermined distance when said piston is extended.

10. The security door lock system as recited in claim 9 wherein said rod holder bar comprises said one rod protruding from a first end area of said bar portion to within said door frame and another rod protruding from a second end area to within said door frame.

11. The security door lock system as recited in claim 9 wherein said rod holder bar attaches to said piston by a pair of spaced apart arms extending from said bar portion of said rod holder bar.

12. The security door lock system as recited in claim 9 wherein said lock system comprises means extending above said bar stabilizer portion for manually locking and unlocking said door lock system.

13. The security door lock system as recited in claim 9 wherein said system comprises an AC power source and means for providing DC power to said system when the AC power source is unavailable.

14. A method of providing a security door lock for use in a wall adjacent to a door and a door frame comprising the steps of:

generating a signal to activate and a signal to deactivate said door lock;

extending a piston attached to an actuator toward a door in response to said activating signal, said piston being positioned in an enclosure adjacent to said door;

attaching a rod holder bar approximately perpendicular to an end of said piston, said rod holder bar comprising a bar portion and a bar stabilizer portion perpendicular to said bar portion;

extending at least one rod from said bar of said rod holder bar into a door frame;

moving said rod from said door frame into said door, when said piston is extended; and stabilizing said rod holder bar means by retaining means attached to a wall of said door lock for allowing said bar stabilizer portion of said rod holder bar to slide in parallel with said extending piston.

15. The method as recited in claim 14 wherein said step of generating a signal to activate and a signal to deactivate said door lock comprises the steps of:

generating a coded signal with a remote control transmitter;

receiving said coded signal in means for decoding said coded signal;

determining said door is closed with sensor means positioned at said door frame prior to providing said activating signal to said piston.

16. The method as recited in claim 14 wherein said step of extending at least one rod from said rod holder bar comprises the step of extending a second rod from said rod holder bar, said rods being spaced apart a predetermined distance.

17. The method as recited in claim 14 wherein said method comprises the step of providing a door sensor to determine said door is closed before allowing said piston to be activated.

18. The method as recited in claim 14 wherein said method comprises the step of manually locking and unlocking said door lock by providing a lever extending from said bar stabilizer portion of said rod holder bar enabling said rod holder bar to be moved back and forth.

19. A housing comprising:

a first generally rectangular area having side walls;

a second generally square area having side walls, said second area extending perpendicular to said first generally rectangular area with no barrier between said first area and said second area;

a rod holder bar disposed within said first area and said second area, an elongated bar portion positioned in said first area and a bar stabilizer portion attached perpendicular to said bar portion and positioned in said second area;

means, attached to an inner wall of said housing, for retaining flanges on lower portions of said bar stabilizer, said retaining means allowing said flanges to slide back and forth;

a lever extending above a top portion of said bar stabilizer for manually moving said rod holder bar back and forth within said housing;

first threaded receptacles for receiving slide tubes positioned on opposite ends of a front panel of said housing;

second threaded receptacles for receiving slider shafts positioned on opposite ends of said bar; and a pair of spaced apart arms extending from said bar parallel to said bar stabilizer.

20. The housing as recited in claim 19 wherein said pair of arms comprises apertures for attaching a piston of an actuator.

21. The housing as recited in claim 19 wherein said rod holder bar comprises wing means for strengthening the intersection of said bar portion and said bar stabilizer portion.

22. A security door lock for mounting under a door comprising:

means for generating a signal to activate and to deactivate said door lock;

means, connected to said signal generating means, for extending a piston a first predetermined distance in response to said activate signal, said piston extending means being attached to a housing for said door lock;

means attached to said piston for moving a rod a second predetermined distance in a direction opposite the direction of said piston;

means, positioned adjacent to said piston extending means and formed as part of said housing, for receiving a hollow tube, said hollow tube being screwed into said part of said housing; and an end of said rod being inserted into said hollow tube and attached to said rod moving means beyond said hollow tube.

23. The security door lock as recited in claim 22 wherein said rod moving means comprises an interleaving rack and cam combination, said rack being attached to said piston extending means and said cam having a cam follower coupled thereto, said cam follower being attached to said rod.

24. The security door lock as recited in claim 22 wherein said rod moving means comprises a rack attached to said piston, said rack comprises teeth which interleave with teeth of a sprocket portion of a cam, said cam driving said rod whereby said rack and cam translate said extending of said piston into moving said rod in said opposite direction.

25. The security door lock as recited in claim 24 wherein said door lock comprises a cam follower having a guide post, and said cam comprises a curved channel for said guide post to travel therein, said cam follower being attached to an end of said rod for moving said rod into said door.

26. The security door lock as recited in claim 24 wherein said rod moves said predetermined distance into a bottom portion of a door, said rod pushing a second rod upward said second predetermined distance within said door and into a door frame above said door.

27. In combination:

a housing for a door lock;

an actuator mounted in said housing having a piston, said piston extending in response to a control signal;

a rack attached to an end of said piston, said rack having a side edge inserted in a linear channel of said housing, said rack having a plurality of teeth;

a cam comprises a sprocket, said sprocket comprises a plurality of teeth, said plurality of teeth of said sprocket positioned to mesh with said plurality of teeth of said rack for driving said cam, said cam further includes an open curved channel;

a cam follower having a guide post, said guide post being positioned in said curved channel of said cam, said cam follower having a stabilizer portion inserted into a linear follower channel of said housing;

a rod attached to said cam follower, said rod being extended by said cam follower for insertion into a door.

28. The combination as recited in claim 27 wherein said combination comprises an outer tube into which said rod is inserted, said outer tube being secured to a portion of said leg housing above said cam follower.

29. The combination as recited in claim 27 wherein said rod extends into a bottom portion of said door pushing a second rod upward within said door and into a door frame above said door.

30. The combination as recited in claim 27 wherein said sprocket of said cam comprises 36 teeth around the circumference of said sprocket.

31. The combination as recited in claim 27 wherein said door lock comprises a manual override cable, said cable connects to a control box mounted in a wall near said door.

32. A method of providing a security door lock for mounting under a door comprising the steps of:

generating a signal to activate and to deactivate said door lock;

extending a piston a first predetermined distance in response to said activate signal, with means connected to said signal generating means, said piston extending means being attached to a housing for said door lock;

moving a first rod a second predetermined distance in a direction opposite the direction of said piston with means attached to said piston extending means, and attaching said first rod to said means attached to said piston extending.

33. The method as recited in claim 32 wherein said method comprises the step of inserting said rod into a hollow tube for lock strength, said hollow tube being attached to said housing.

34. The method as recited in claim 32 wherein said method comprises the step of providing a second elongated rod within said door and positioning said first rod to push said second rod upward out of said door and into a door frame above said door.

* * * * *